US011255346B2

(12) United States Patent
Loercher

(10) Patent No.: US 11,255,346 B2
(45) Date of Patent: Feb. 22, 2022

(54) FAN AND INLET GUIDE GRID FOR A FAN

(71) Applicant: ZIEHL-ABEGG SE, Künzelsau (DE)

(72) Inventor: Frieder Loercher, Braunsbach (DE)

(73) Assignee: ZIEHL-ABEGG SE, Künzelsau (DE)

( * ) Notice: Subject to any disclaimer, the term of this patent is extended or adjusted under 35 U.S.C. 154(b) by 0 days.

(21) Appl. No.: 16/617,979

(22) PCT Filed: May 22, 2018

(86) PCT No.: PCT/DE2018/200053
§ 371 (c)(1),
(2) Date: Nov. 27, 2019

(87) PCT Pub. No.: WO2018/219414
PCT Pub. Date: Dec. 6, 2018

(65) Prior Publication Data

US 2020/0116165 A1 Apr. 16, 2020

(30) Foreign Application Priority Data

Jun. 1, 2017 (DE) ..... 10 2017 209 291.2

(51) Int. Cl.

| | |
|---|---|
| ***F04D 29/70*** | (2006.01) |
| ***F04D 29/66*** | (2006.01) |
| ***F04D 29/42*** | (2006.01) |
| ***F04D 29/44*** | (2006.01) |
| ***F04D 29/54*** | (2006.01) |

(52) U.S. Cl.
CPC ..... *F04D 29/667* (2013.01); *F04D 29/4213* (2013.01); *F04D 29/444* (2013.01); *F04D 29/542* (2013.01); *F05D 2250/51* (2013.01); *F05D 2260/607* (2013.01)

(58) Field of Classification Search
CPC .... F04D 29/441; F04D 29/444; F04D 29/541; F04D 29/542; F04D 29/667; F04D 29/703; F05D 2250/51; F05D 2260/607
See application file for complete search history.

(56) References Cited

U.S. PATENT DOCUMENTS

| | | | | |
|---|---|---|---|---|
| 5,951,245 | A | 9/1999 | Sullivan | |
| 6,092,988 | A * | 7/2000 | Botros | F04D 29/667 415/191 |
| 9,618,007 | B2 * | 4/2017 | Iyer | F04D 29/444 |
| 9,835,176 | B2 * | 12/2017 | Hustvedt | F04D 29/665 |
| 2013/0045085 | A1 | 2/2013 | Frank et al. | |
| 2013/0052000 | A1 | 2/2013 | Su | |

(Continued)

FOREIGN PATENT DOCUMENTS

| | | | |
|---|---|---|---|
| DE | 9101715 | U1 | 5/1991 |
| DE | 4404262 | A1 | 8/1995 |
| DE | 202015104813 | U1 | 10/2015 |

(Continued)

*Primary Examiner* — Ninh H. Nguyen
(74) *Attorney, Agent, or Firm* — Jason P. Mueller; FisherBroyles, LLP

(57) ABSTRACT

A fan (radial or axial fan), with an impeller and with a preguide device in the flow path in front of the impeller, preferably in front of the inlet region of an inlet nozzle, has the preguide device as a preguide grid with webs and/or guide vanes which are arranged and shaped such that flow influencing in the circumferential direction occurs for a substantially swirl-free inflow.

15 Claims, 20 Drawing Sheets

(56) References Cited

U.S. PATENT DOCUMENTS

2014/0209275 A1* 7/2014 Schone ..... F04D 29/541
165/96

FOREIGN PATENT DOCUMENTS

| | | | | | |
|---|---|---|---|---|---|
| DE | 102015105676 | A1 * | 10/2016 | ..... | F04D 17/16 |
| DE | 102015115308 | A1 | 3/2017 | | |
| EP | 1367262 | B1 | 11/2006 | | |
| EP | 2123917 | A2 | 11/2009 | | |
| EP | 2541068 | A1 | 1/2013 | | |
| WO | 03054395 | A1 | 7/2003 | | |
| WO | 2015124237 | A1 | 8/2015 | | |

* cited by examiner

FAN AND INLET GUIDE GRID FOR A FAN

This application is a national stage entry under 35 U.S.C. 371 of PCT Patent Application No. PCT/DE2018/200053, which claims priority to German Patent Application No. 10 2017 209 291.2, filed Jun. 1, 2017, the entire contents of each of which are incorporated herein by reference.

The present invention relates to a fan, which may be either a radial or an axial fan. The fan comprises an impeller having a preguide device in the flow path in front of the impeller, preferably in front of the inlet region of an inlet nozzle.

A fan of this kind with inflow-side preguide device is known for example from WO 03/054395 A1. The preguide device provided there serves primarily for flow equalization, and also especially for noise reduction. The known preguide device generates a pre-swirl in the direction of rotation of the impeller. It is significant that any acoustical improvements achieved usually come with losses in air flow and efficiency.

So-called preguide wheels are also already known in practice, which serve for improving the efficiency and/or air flow. However, these preguide wheels cause acoustical disadvantages and they are complicated in design and in their installation in the respective fan products. They are usually not installed in front of inlet nozzles and thus do not have any large flow surface as compared to the fan. Hence, the air velocities in the region of these preguide wheels are relatively high, which causes in particular the acoustical disadvantages.

Now, problem which the present invention proposes to solve is to design and modify a fan with a preguide device such that the air flow and/or the efficiency are enhanced with improved, the same, or only slightly worse acoustical values. The tonal noise produced at the fan as a result of inhomogeneous inflow can be reduced, since the preguide grid equalizes the inflow. The preguide grid should be produced in cost effective manner and easy to install.

Furthermore, a fan should be created which is distinguished from competing products. A corresponding preguide grid should likewise be proposed, with which a radial or axial fan can be outfitted in order to satisfy the requirements indicated above.

According to the invention, the above problem is solved by the features of claim 1. Accordingly, in the fan of this kind the preguide device is designed as a preguide grid with webs which are arranged and shaped such that flow influencing in the circumferential direction occurs for a substantially swirl-free inflow. The term "web" should be understood in the broadest sense.

In regard to the preguide grid according to the invention, the above problem is solved by the features of the coordinated claim 14.

Advantageously, the webs are arranged and shaped such that by a flow deflection in the circumferential direction a pre-swirl is generated against the direction of rotation of the impeller. The pre-swirl against the direction of rotation of the impeller has the effect of increasing the air flow and/or boosting the efficiency as compared to the same fan without preguide grid. Acoustical disadvantages are slight, since the air guide device at the inflow side is situated in a region where the flow velocities are low. The tonal noise produced at the fan as a result of inhomogeneous inflow can be reduced, since the preguide grid equalizes the inflow.

In one advantageous embodiment, radially extending webs of a preguide grid are guide vanes, but they deviate from an exactly radial orientation and/or are inclined, curved, rotated or twisted in themselves. The guide vanes may have in cross section the shape of an airfoil. These guide vanes may be joined together by transverse webs to form a grid. Thanks to this gridlike structure, the aforementioned pre-swirl is generated, with the effect of increasing the air flow and/or increasing the efficiency with benefits or only slight disadvantages in regard to the acoustics.

Embodiments are conceivable that are especially easy to fabricate. This is particularly the case when radial webs have constant wall thickness and/or run straight or level and/or their skeletal surfaces are oriented exactly in the axial direction. It is advantageous when the preguide grid can be stripped from an injection mold without a slider.

It is also conceivable for the preguide grid to be built similar to an unstructured grid, such as a honeycomb grid, as long as it is designed to generate the pre-swirl.

The preguide grid according to the preceding remarks comprises many small webs which are arranged at relatively large distance from the impeller, namely, according to the design and arrangement of the preguide device. In particular, the preguide grid is situated in the flow path in front of an inlet nozzle. In this way, the bathed surface can be significantly larger than the bathed cross sectional area in the region of the entrance to the fan impeller. Consequently, the air velocities are low in the region of the preguide grid, which has an advantageous effect in regard to noise production and fluidic losses. The effect of the interaction of a so-called trailing depression with the impeller blades is slight in this case. The preguide grid, similar to a flow straightener, ensures a certain flow equalization and thus results in improvements for tonal noise, especially in event of perturbed inflow conditions—howsoever they are caused.

Ultimately, a pre-swirl with a kind of flow straightener is generated according to the invention. The enhancing of the air flow and the efficiency is combined with at least less acoustical impairment or improvement in the case of perturbed inflow conditions, which is due to the special design of the air guide device in the sense of a preguide grid.

The shape or contour of the preguide grid is dependent on whether the fan is a radial fan or an axial fan. In particular, in the case of a radial fan, it is advantageous for the preguide grid to be fashioned as a hood. If the fan is an axial fan, the preguide grid could be fashioned as an annular ring, and the annular ring could be closed in the middle by a functional element. Specifically, an integrated or separate flow hood can be provided, which is adjacent to the preguide grid or secured in the preguide grid. The flow is then advantageously guided on a contour in the inside region (the hub region).

The preguide grid can be made from plastic as a single piece or multiple pieces. It is preferably made by injection molding. Advantageously, it has features which allow a fastening of the preguide grid to a nozzle plate, for example.

It is conceivable for the preguide grid to take on the function of a guard grille.

The fan may be used in any given ventilation layouts, such as in a housing, an air conditioner, an air conditioning or ventilating wall, etc. In particular, it is conceivable for a heat exchanger to be arranged preferably at the suction side, regardless of which particular fan type is involved.

The preguide grid according to the invention comprises the features of the above discussed fan in regard to the preguide grid. It may be retrofitted on the particular fan, namely in the course of a retrofitting. A replacement is also possible.

In the case of an axial fan with adjustable stagger angles of the blades, a required air flow can be achieved with a lower stagger angle by using the preguide grid than without a preguide grid. In this way, the required air flow is achieved with substantially higher efficiency.

Now, there are various possibilities of embodying and modifying the teaching of the present invention in advantageous manner. On the one hand, refer to the claims which follow claim 1 and on the other hand refer to the following explanation of preferred exemplary embodiments of the invention with the aid of the drawing. In connection with the explanation of preferred exemplary embodiments of the invention with the aid of the drawing, generally preferred embodiments and modifications of the teaching are also explained. The drawing shows:

FIG. 1 in a perspective view, an exemplary embodiment of a preguide grid according to the invention, FIG. 2 in a front view, the preguide grid of FIG. 1, FIG. 3 in a cross section in a plane perpendicular to the longitudinal axis, the preguide grid of FIGS. 1 and 2, FIG. 4 in a schematic view, another exemplary embodiment of a preguide grid according to the invention with flow guide at the hub, FIG. 5 in a side view, the preguide grid of FIG. 4, FIG. 6 in a front view, the preguide grid of FIGS. 4 and 5, FIG. 7 in a cross section in a plane perpendicular to the longitudinal axis, the preguide grid of FIGS. 4 to 6, FIG. 8 in a cross section in a plane perpendicular to the longitudinal axis, the preguide grid from FIGS. 4 to 7, FIG. 9 in a schematic view, in a cross section along the longitudinal axis, a radial fan with a preguide grid according to the invention per one of FIGS. 1 to 3, FIG. 10 in a schematic view, in a cross section along the longitudinal axis, an axial fan with a preguide grid according to one of FIGS. 4 to 8, FIG. 11 a fan with preguide grid according to FIG. 10 with axially arranged suction-side heat exchanger, FIG. 12 another variant of a fan with preguide grid according to FIG. 10 with radially arranged suction-side heat exchanger, FIG. 13 in a schematic view, the object of FIG. 9, where only the preguide grid is shown sectioned, and additional schematic definitions are drawn, FIG. 14 in a perspective view, an exemplary embodiment of a preguide grid not generating any pre-swirl, FIG. 15 in a front view, the preguide grid of FIG. 14, FIG. 16 in a cross section in a plane orthogonal to the longitudinal axis, the preguide grid of FIGS. 14 and 15, FIG. 17 in a perspective view, an exemplary embodiment of a preguide grid generating pre-swirl and whose radial webs run slanted to the radial direction, but are not curved, FIG. 18 in a front view, the preguide grid of FIG. 17, FIG. 19 in a perspective view, an exemplary embodiment of a preguide grid generating pre-swirl and whose radial webs are curved, yet straight looking in the axial direction, and FIG. 20 in a front view, the preguide grid of FIG. 19.

FIG. 1 shows in a perspective view a preguide grid 1 according to the invention, which is suitable in particular for a radial fan, not shown in FIG. 1. The preguide grid 1 is arranged advantageously in front of the inlet region of an inlet nozzle. It comprises radial webs 2, which are joined together by transverse webs 3 to form a kind of hood. By arranging the preguide grid 1 in front of the inlet region of the inlet nozzle of the fan, a pre-swirl is generated against the direction of rotation of the fan impeller.

FIG. 9 shows in a schematic view, in the cross section along the longitudinal axis, an application of the preguide grid 1 according to the invention per FIG. 1, in combination with a radial fan 6 with radial impeller 12, being only suggested in FIG. 9. The arrangement in the installed state is to be understood for example as an element of a ventilator wall, air conditioning wall, or the like.

In FIG. 9, the preguide grid 1 per FIG. 1 is represented in cross section with an inlet nozzle 9, which is integrated in a nozzle plate 10, and a fan 6 with impeller 12. In operation, the fan 6 due to the rotation of the impeller 12 sucks in air through the preguide grid 1 and then through the inlet nozzle 9. In the impeller 12 of the fan 6, energy is transferred to the air by its rotational movement, thereby driving the flow, before it emerges once more from the impeller 12 at the fan outlet. In front of the entry to the preguide grid 1, the air has little or no velocity component in the circumferential direction relative to the fan axis, especially in a time and space averaging over the inflow region of the preguide grid. In this connection, one speaks of a substantially swirl-free inflow on average, which is generally present in fan applications. Time and/or space fluctuations of the inflow velocity, which occur in many installation situations of fans, are reduced by flowing through the preguide grid 1. In this way, it is possible to reduce the formation of noise and vibrations during operation of the fan 6. The reduction of the time and space fluctuations of the air velocities results from the relatively narrow air passages which are defined by the grid web structure and in which the air is guided accordingly. In order to have narrow air passages, a relatively large number of webs are necessary, especially radial or transverse webs 2, 3, which in turn define a relatively large number of air passages. Thus, in the exemplary embodiment, 30 radial webs 2 are formed distributed over the circumference. Around 91 air passages are formed. In order to decrease the air resistance, the webs are preferably thin in configuration. Typical wall thicknesses of the webs 2, 3 are 0.5 mm to 3 mm, but one must take into account the manufacturing feasibility and strength of a preguide grid 1. Furthermore, the webs 2, 3 have a certain height, looking in the flow direction, in order to effectively reduce the fluctuations in the air velocities. Typical heights in the flow direction are 8 mm to 30 mm.

FIG. 9 clearly shows that the preguide grid lies in the flow path in front of the inlet nozzle and thus in front of a narrowing of the flow cross section. The overall flow cross section in the region of the preguide grid is significantly larger than the narrowest flow cross section in the inlet nozzle 9. Advantageous is a factor of at least 2 by which the overall flow cross section of the preguide grid is larger compared to the narrowest flow cross section in the inlet nozzle. In this way, the air velocities are relatively low in the region of the preguide grid, which is advantageous for low noise and low pressure losses at the preguide grid. In particular, this is advantageous when the preguide grid is used to generate a pre-swirl, as in the exemplary embodiment.

FIG. 13 shows a comparable design to FIG. 9, where only the impeller 12 of the fan 6 and only the preguide grid 1 are shown in cross section. The preguide grid 1 is represented in schematic fashion by its skeletal surfaces 11, i.e., without the wall thicknesses required for manufacturing purposes. These skeletal surfaces 11 correspond to the center surfaces of the webs 2, 3 having the wall thicknesses. In addition, an air velocity vector v1 is indicated schematically at a place in the flow path in front of the preguide grid. After passing through the preguide grid, the air may have a different velocity v2.

FIG. 13 further shows coordinate systems useful in the description of the invention. Each time the origin is the imaginary intersection of the fan axis with the plane of the nozzle plate 10. There is shown a Cartesian coordinate system with the coordinates (x, y, z), where the z-axis lies on the fan axis. Furthermore, there is shown a spherical coordinate system with the coordinates (r, φ, Θ), which are explained with the help of any given point P. r describes the distance from the origin, φ describes the angle between the radial stream projected onto the x-y plane joining P to the origin and the positive x-axis, and Θ describes the angle between this radial stream and the z-axis. The definition of such spherical coordinate systems is generally known. Now, at any given point, it is possible to indicate directions corresponding to variations in r, φ or Θ (each time holding the other two coordinates constant). The r-direction is termed the radial direction, the (p-direction is the circumferential direction (corresponding to the direction of rotation about the z-axis or the fan axis), and the Θ-direction is the polar direction. Three-dimensional vectors, for example velocities or surface normals, can now be expressed in the form of three components, each representing the projection of the vector in the radial, circumferential, and polar direction.

An incoming flow v1 can thus be represented in spherical coordinates v1=(v1r, v1φ, v1Θ). Here, v1 and the components v1r, v1φ and v1Θ generally depend on place and on time. For a substantially swirl-free inflow v1 on average (in space and/or in time), the circumferential component v1φ in front of the preguide grid 1 is zero or very small, at least in a space or time average. A component v1φ of the inflow velocity v1, multiplied by the local axial distance, is a measure of the swirl about the fan axis which the inflow has in front of the preguide grid. A simplified averaged model inflow v1 has only one component in the radial direction (the r-component) in the entire inflow region, i.e., v1=(v1r, v1φ, v1Θ)≈(v1r,0,0), where v1r is dependent on the location.

The preguide grid 1 according to FIG. 1, 9, 13 generates a pre-swirl in the air flowing through. That is, the air velocity v2 after passing through the preguide grid 1 has a significant swirl about the fan axis in the space and time average in front of the entrance to the impeller 12 of the fan 6. The circumferential component (φ-component) v2φ of the velocity v2=(v2r, v2φ, v2Θ) after the preguide grid is thus distinctly different from 0 in a space and time average. The sign of v2φ describes the direction of rotation of the pre-swirl. This can generally be identical or opposite to the direction of rotation of the fan. Advantageously for the air flow of the fan, it is opposite to the fan direction of rotation. As seen in the space and time average, for example, after flowing through the preguide grid 11, the magnitude of the component v2φ may be more than 5% greater than the magnitude of the total velocity v2 of the air, which then has a significant swirl about the fan axis, before it enters the impeller 12.

For a skeletal surface 11 of the preguide grid 1, FIG. 13 shows as an example a surface normal n at one point, which can also be expressed in radial, circumferential and polar components (nr, nφ, nΘ). For the further discussion, all surface normal vectors are assumed to be normalized to the length 1.

With the aid of the normal vectors n of the skeletal surfaces 11, a statement can be made as to whether a preguide grid provides a pre-swirl to a substantially swirl-free inflow v1 on average as it flows through the grid, i.e., whether it generates a significant velocity component v2φ in the circumferential direction.

For this, first of all in a local treatment (considering a surface element at a given preguide grid position), two conditions are stated. Firstly, a skeletal surface 11 must stand at an angle of attack to the inflow direction, i.e., its normal vector n must not be orthogonal to the local inflow direction v1, which can be modeled in simplified manner, as described, by v1=(v1r, v1φ, v1Θ)≈(v1r,0,0). For such an inflow, the condition is fulfilled when a normal vector has a radial component nr which is significantly different from zero in absolute magnitude, advantageously |nr|>0.1. In other words, a normal vector of a skeletal surface must have a significant radial component. The second condition is that a flow deflection must occur in the circumferential direction, i.e., a reaction moment must arise in the circumferential direction, which is tantamount to a component in the circumferential direction nφ of the normal vector n which is significantly from 0 in absolute magnitude, advantageously |nφ|>0.1. In other words, a normal vector must have a significant component pointing in the circumferential direction. In order for a skeletal surface segment to generate a pre-swirl, both conditions must be fulfilled at the same time. The generated pre-swirl is generally higher for a particular skeletal surface segment as the value of the product nr*nφ is higher. This also means that the strength of the pre-swirl can be controlled with the geometrical configuration of the preguide grid. The sign of the product nr*nφ indicates the rotation direction of the generated circumferential component v2φ, i.e., the pre-swirl, in the swirl-free inflow being described (a positive sign means a rotation direction of the pre-swirl in the positive direction of the coordinate φ).

The local treatment must further be expanded to an overall treatment in which all surface elements of all skeletal surfaces are considered in total. In order to generate a desired pre-swirl in a time and space average, it is generally sufficient for a portion of all skeletal surfaces to have a normal vector for which the absolute magnitude of the product nr*nφ is greater than 0, i.e., there may also be a portion of skeletal surfaces for which nr*nφ=0. However, the effect of two skeletal surface segments may mutually cancel out, as regards the space averaging of the swirl, namely, if the swirl portions generated at different skeletal surface segments cancel out in total, since they have different signs. In order to have a significant pre-swirl in a space and time average after flowing through the preguide grid 1, i.e., in order to have a significant average circumferential velocity v2φ, the surface mean value [nr*nφ] of the (signed) product nr*nφ must be significantly different from zero over the totality of the skeletal surfaces 11 of a preguide grid. This is especially the case when the absolute magnitude of the surface mean value [nr*nφ] is greater than 0.01, advantageously greater than 0.05. In this treatment, the effect of opposite pre-swirl generation at different points of the preguide grid canceling out on average is taken into account, i.e., when different pre-swirl-generating regions cancel out on average, the surface mean value [nr*nφ] also becomes zero or close to zero.

FIG. 2 shows the preguide grid 1 of FIG. 1 in a front view. This view reveals that both the radial webs 2 and the transverse webs 3 are at least slightly rotated or inclined or tilted with regard to the longitudinal axis. The normal vectors of the transverse webs 3 have throughout a circumferential component of zero, i.e., the transverse webs 3 in the exemplary embodiment do not contribute to the pre-swirl generation, since the product nr*nφ is zero. The radial webs 2, on the other hand, contribute to the pre-swirl generation. The corresponding normal vectors have a circumferential component greater than 0.95 in absolute magnitude, since the radial webs 2 are primarily oriented in the circumferential direction, however due to their distinctly recognizable curvature they also have a component in the direction of the spherical radials as defined with the aid of FIG. 13, amount in absolute magnitude to around 0.07 on average over the radial webs 2. Hence, a surface mean value [nr*nφ] of around 0.07 results for the radial webs and a surface mean value [nr*nφ] of around 0.05 results for the overall preguide grid. This preguide grid generates a very low pre-swirl, for which the absolute magnitude of the circumferential velocity after flowing through the preguide grid amounts on average to around 10% of the absolute magnitude of the total velocity. Even so, the air flow and the efficiency can be measurably increased with such a preguide grid if the direction of turning of the pre-swirl is oriented contrary to the direction of turning of the impeller. Preguide grids with low pre-swirl are characterized by especially low sound production at the fan impeller. Furthermore, a low pre-swirl has the advantage that fans which have been designed for pre-swirl-free operation are optimally suited to such a pre-swirl grid.

Generally, a pre-swirl contrary to the direction of rotation of a fan impeller means a boosting of the air flow as compared to the pre-swirl-free operation of the same fan impeller.

The cross sectional representation in FIG. 3 distinctly shows that the radial webs 2 do not run exactly radially, so that a flow deflection is generated in the circumferential direction, as the surface normals are not oriented exactly in the circumferential direction, but instead also have a radial component. The pre-swirl generation points in the same direction of rotation for all radial webs 2, since the product nr*nφ always has the same sign. Furthermore, it can be seen that the radial webs 2 are curved in configuration. This enables a particularly low-loss deflection of the flow in the circumferential direction. Radially on the outside, in the region of the inflow, the radial component nr of the local normal vector is still close to zero, i.e., the skeletal surface here still stands roughly parallel, i.e., with no angle of attack, to the inflow, so that impact losses are minimized. Only because of the curvature of the webs doe the component nr of the normal vector become larger in absolute magnitude, which then results in a flow deflection in the circumferential direction. A curved configuration of the pre-swirl-generating surfaces is advantageous, but it may be more difficult to manufacture than a non-curved configuration of the webs 2, 3. Because of the curved configuration, the webs may also be seen as being guide vanes.

As already mentioned at the outset, there are fans with a preguide grid in the prior art, but these do not generate any pre-swirl. Such preguide grids are aerodynamically speaking an obstacle in the flow path. Accordingly, the air flow and the efficiency decrease when providing such a preguide grid. On the contrary, the preguide grid according to the invention creates a pre-swirl and thereby significantly increases the air flow. The efficiency can likewise be increased at least slightly.

While the design of a fan with a traditional preguide grid distinctly reduces in particular the first three harmonics of the blade sequence frequency, this improvement in the case of a preguide grid according to the invention comes with additional aerodynamic improvements.

FIGS. 14-16 show a preguide grid 1 not generating any pre-swirl. Such a preguide grid can reduce space and time fluctuations in the inflow and thus reduce the noise generated at the fan. In this preguide grid, the product nr*nφ s equal to zero for all skeletal surfaces, i.e., in particular the surface mean value [nr*nφ] is also equal to zero. The normal vectors of the radial webs 2 at no place have a radial component nr, as can be well seen in FIG. 15 and FIG. 16, and thus they have no angle of attack to the inflow. The normal vectors of the circumferential webs 3 at no place have a circumferential component nφ, and thus generate no reaction moment in the circumferential direction and hence no flow deflection in the circumferential direction. In FIG. 15 it can be well seen that the radial webs 2 are oriented exactly in the axial direction, which greatly facilitates the mold stripping in an injection molding die.

FIGS. 17-18 show a preguide grid 1 which generates a pre-swirl in the space and time averaging, but does not have any curved webs. It can be seen in FIG. 18 that the normal vectors of the skeletal surfaces of the radial webs 2 each have a component in the radial direction nr not equal to zero and a component in the circumferential direction nφ not equal to zero. At the same time, the radial webs 2 are oriented axially (FIG. 18), which is advantageous for the ease of stripping from an injection molding die.

FIGS. 19-20 show a preguide grid 1 which generates a pre-swirl in space and time averaging, and which has curved radial webs 2. It can be seen in FIG. 20 that the normal vectors of the skeletal surfaces of the radial webs 2 each have a component in the radial direction nr not equal to zero and a component in the circumferential direction nφ not equal to zero. The curved configuration of the radial webs 2 makes it possible to minimize the flow losses at the preguide grid 1 for the same pre-swirl generation. Despite their curvature, the radial webs 2 are axially oriented (FIG. 20), which in turn is advantageous for the ease of stripping from an injection molding die. The radial webs 2 are not continuous from the outer radius of the preguide grid to the inner radius of the preguide grid. This is not necessary. A completely free configuration of the preguide grid 1 is also conceivable, similar to an unstructured grid. Neither do the transverse webs 3 need to be continuous. This would not change the criteria described for the pre-swirl generation.

At this point it should be noted that the preguide grid 1 according to the invention can be made of plastic, in a single piece or multiple pieces, preferably by injection molding. Points of intersection of the radial webs 2 with the transverse webs 3 may be difficult to strip from the mold, especially on account of a curvature or inclination of the radial webs 2. For the mold stripping without a slider in the die, it may be required to provide local material fillings or backfillings. A fabrication from multiple pieces or segments may also be attractive, as long as the preguide grid does not have any load-bearing function. On the other hand, if the preguide grid is supposed to perform a load-bearing function, a single-piece, stable configuration of the preguide grid is preferable. This also holds when the preguide grid 1 is supposed to also perform the function of a guard grille.

The most diverse devices may be provided on the preguide grid 1 in order to secure it for example to an inlet nozzle 9 or a nozzle plate 10.

The preguide grid 1 may also be designed so that at the same time it performs the function of a guard grille.

Figure 10:
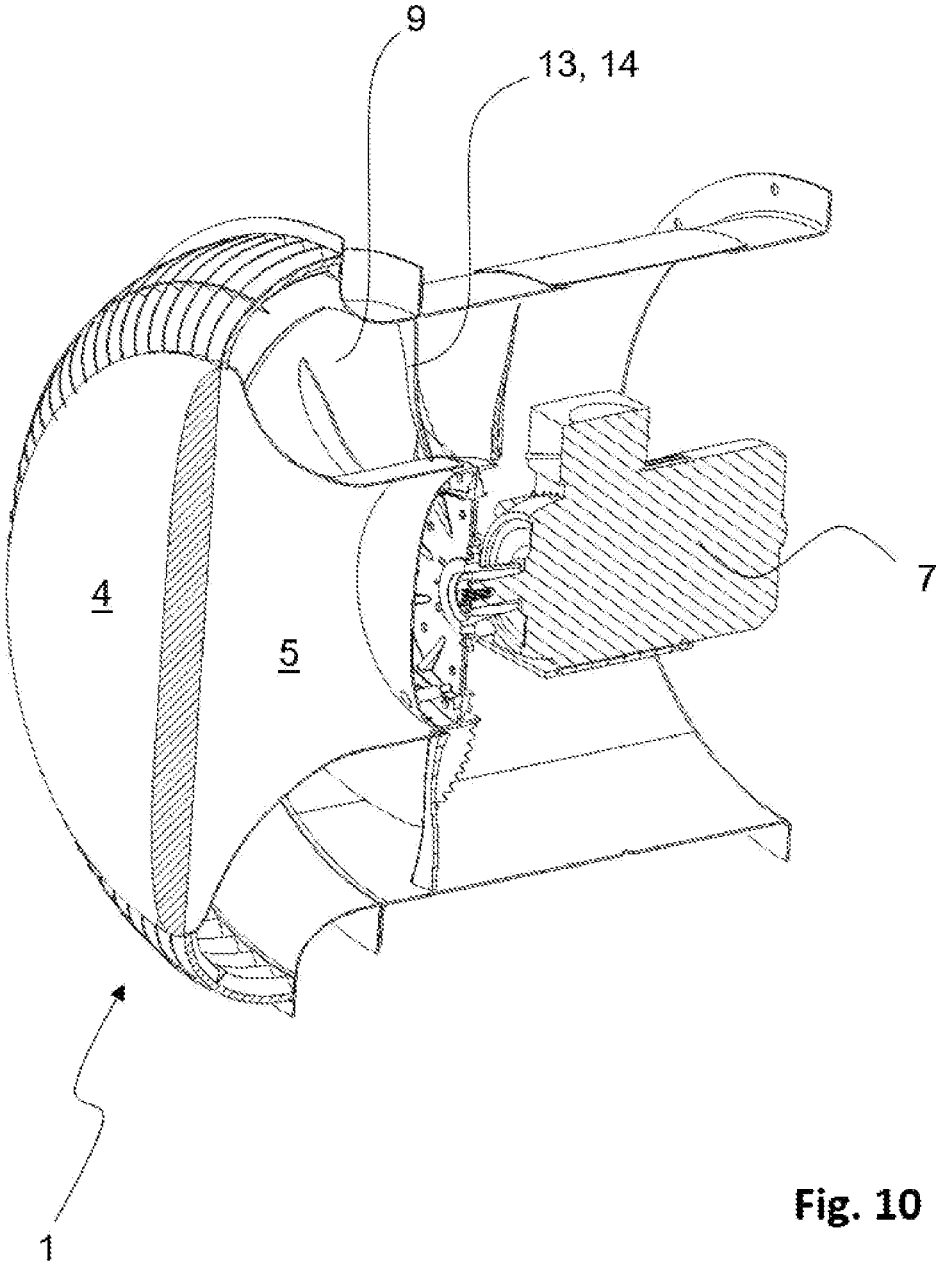
Figure 11:
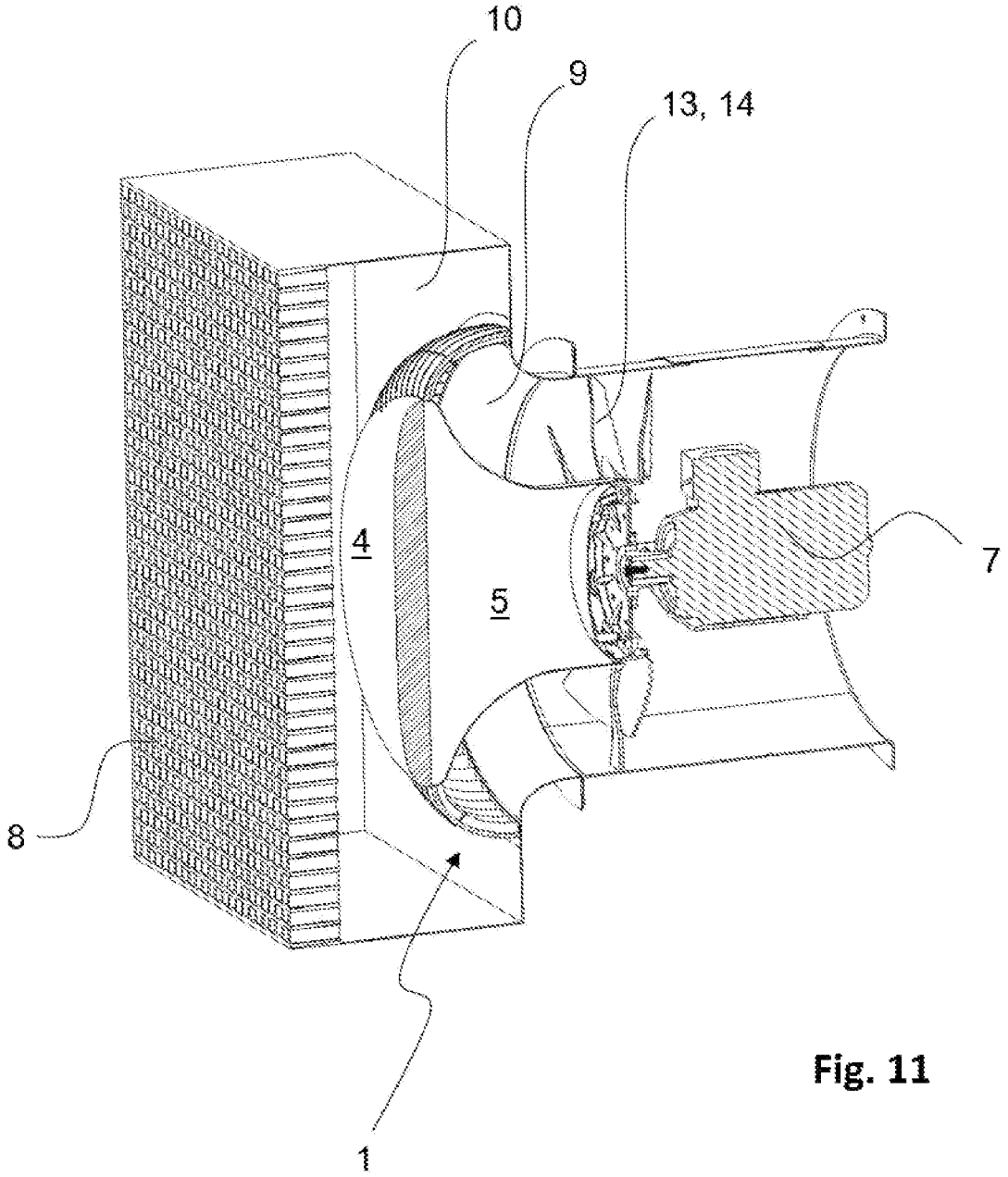
Figure 12:
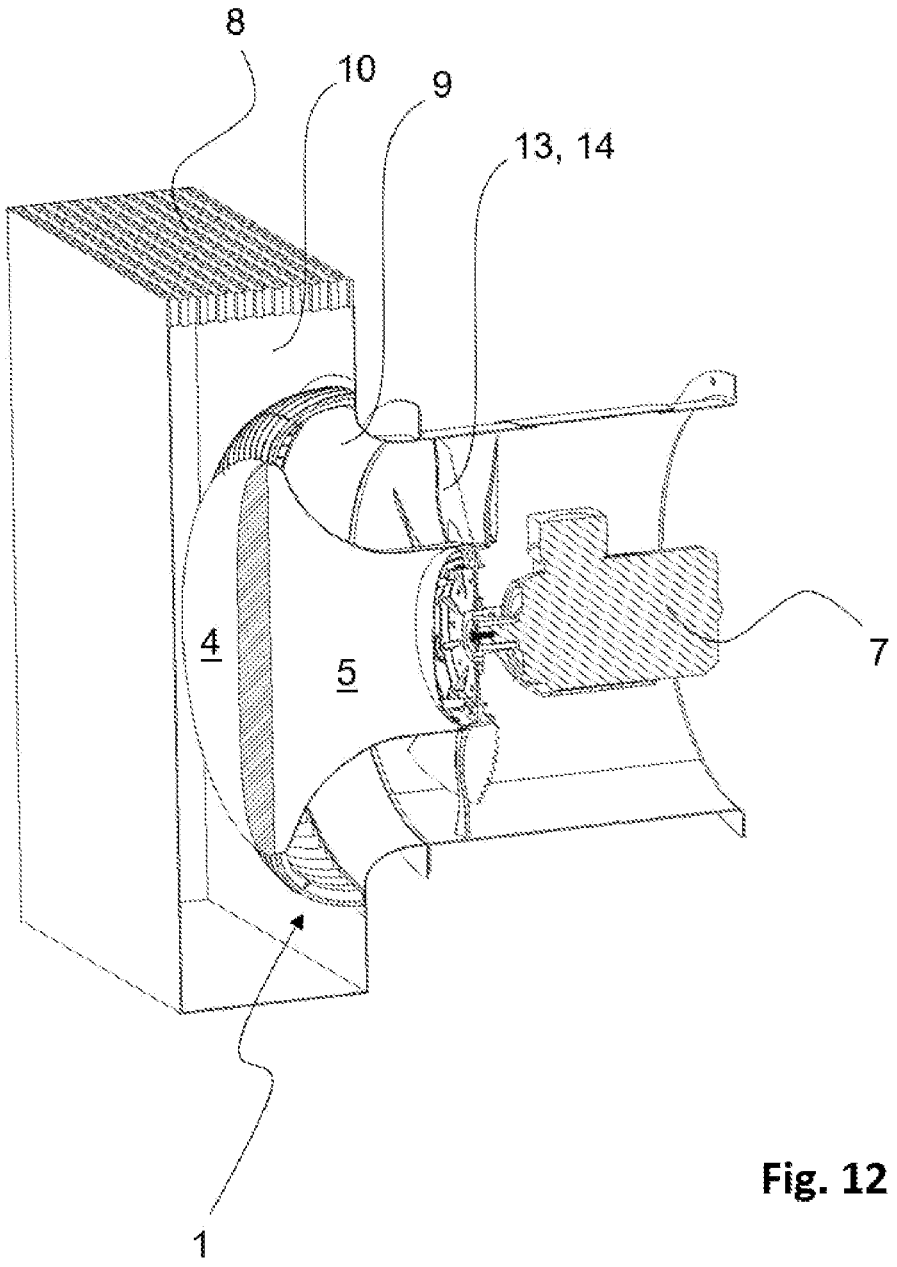
Figure 13:
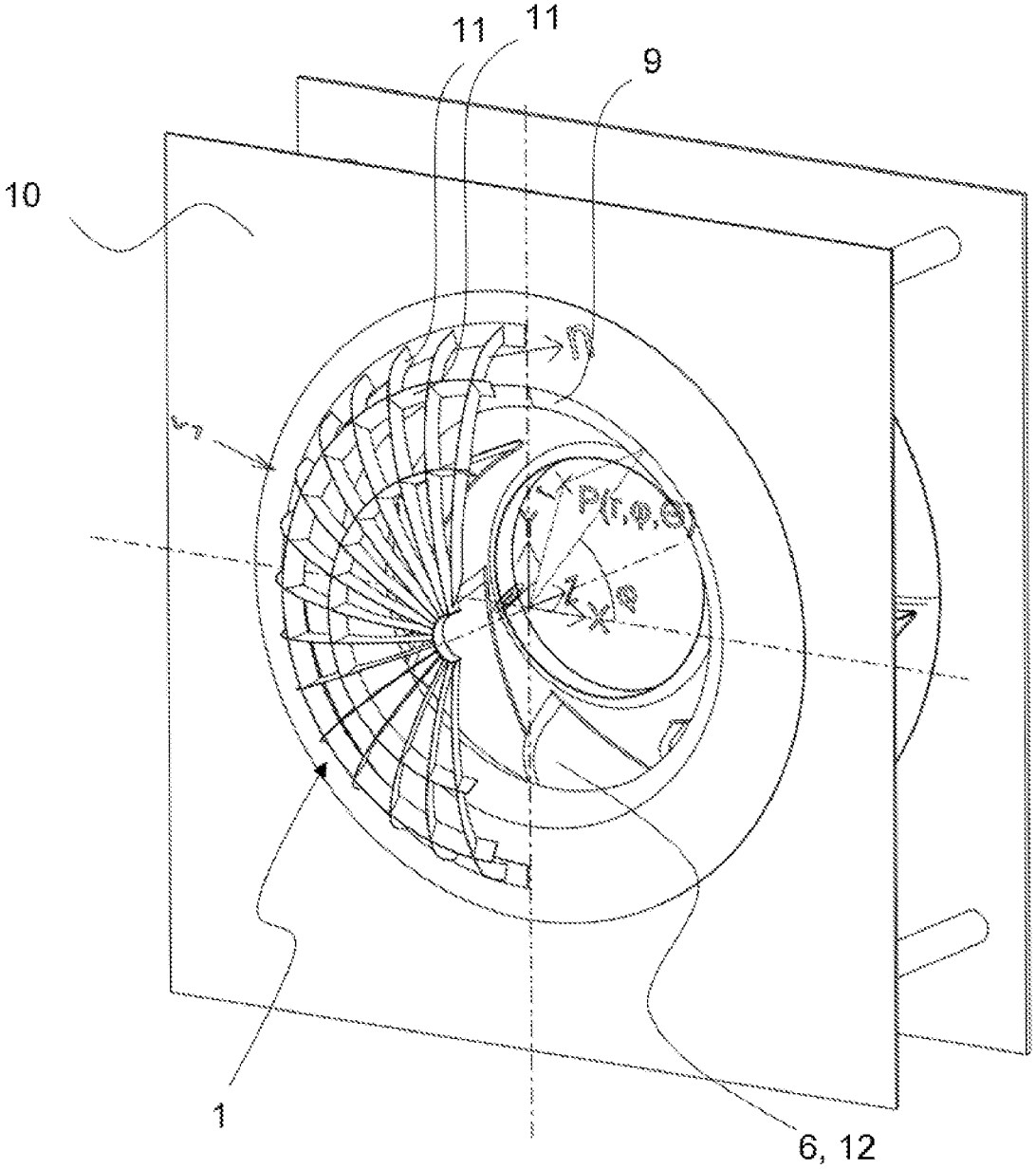
Figure 14:
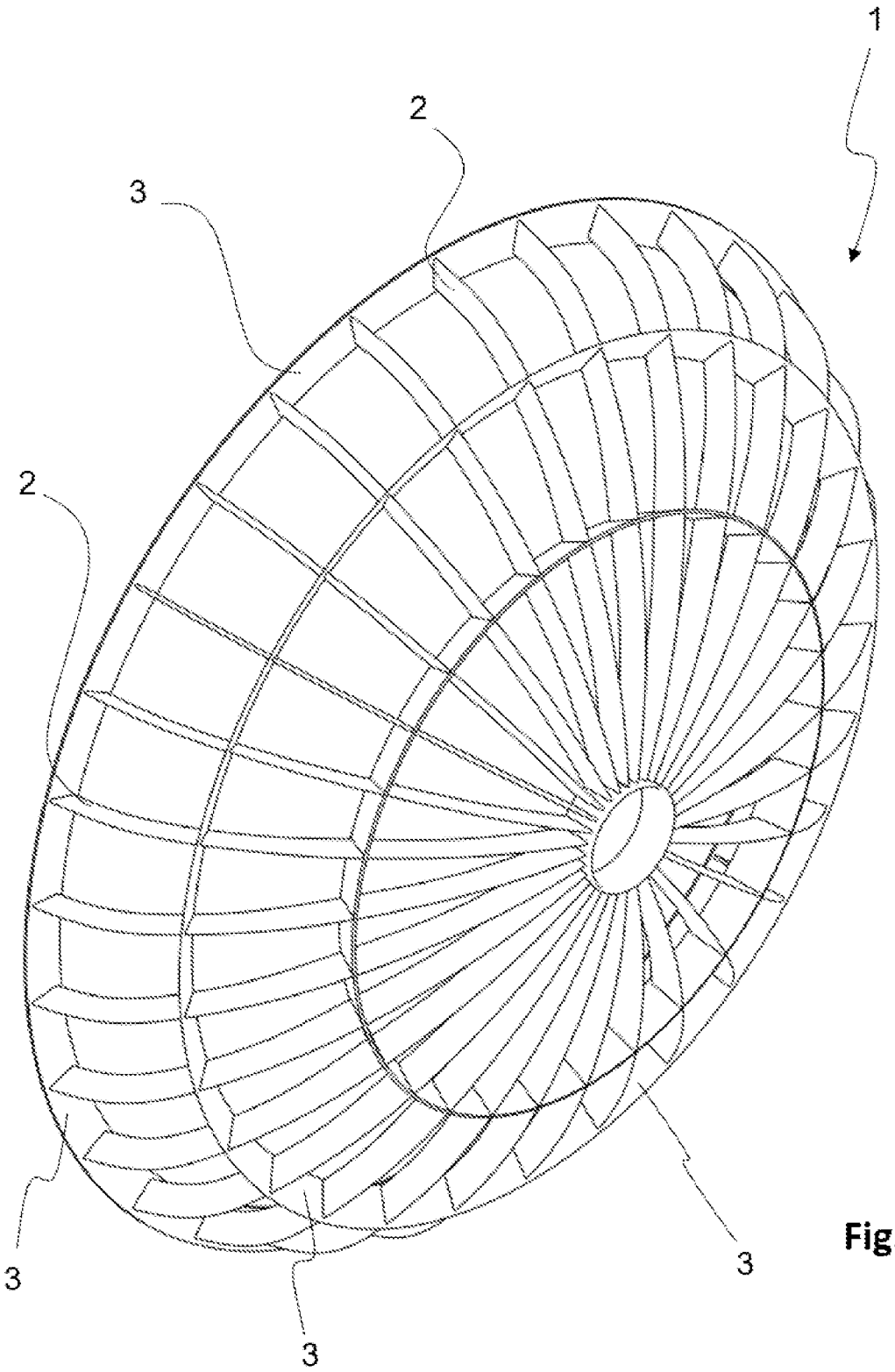
Figure 15:
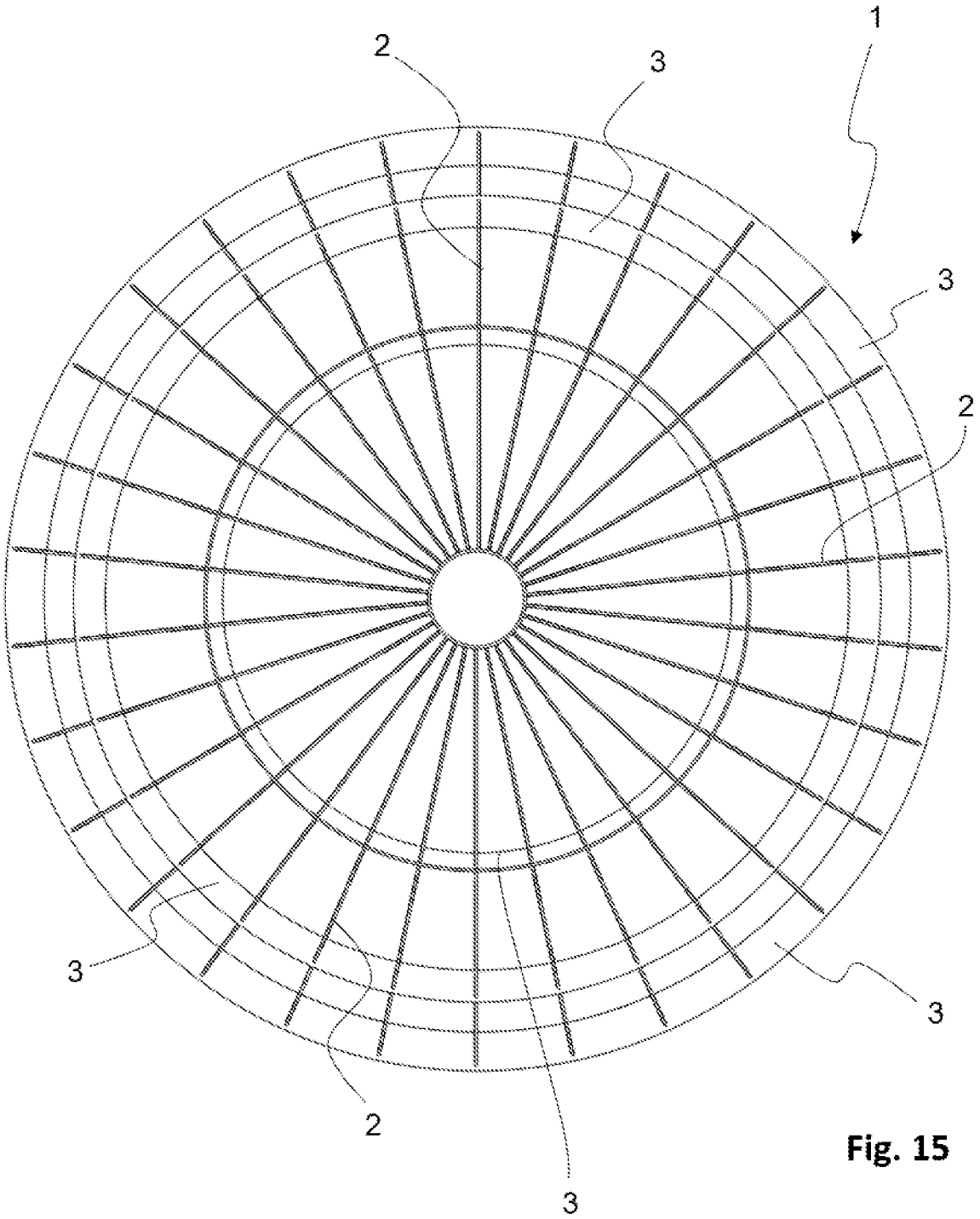
Figure 16:
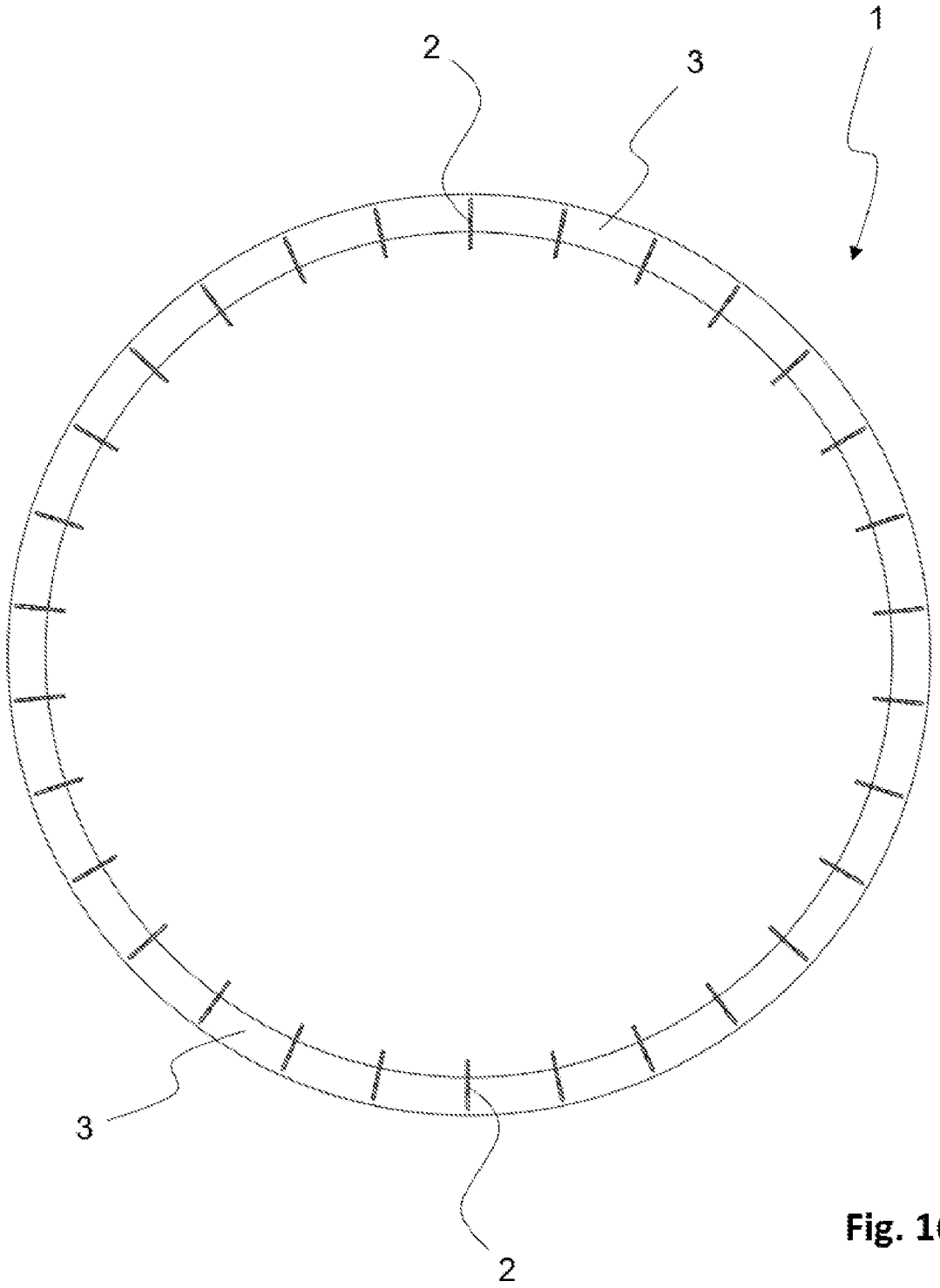
Figure 17:
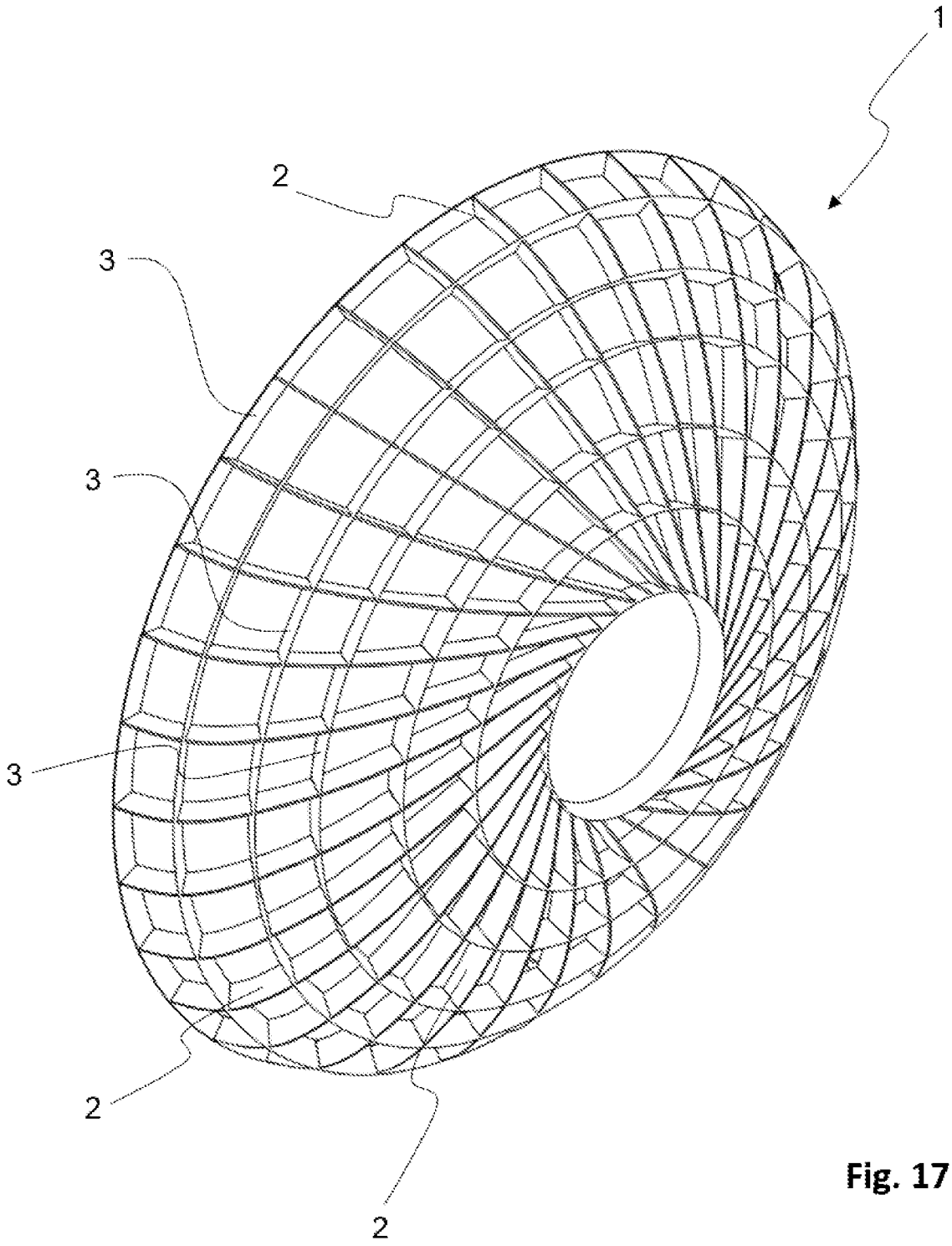
Figure 18:
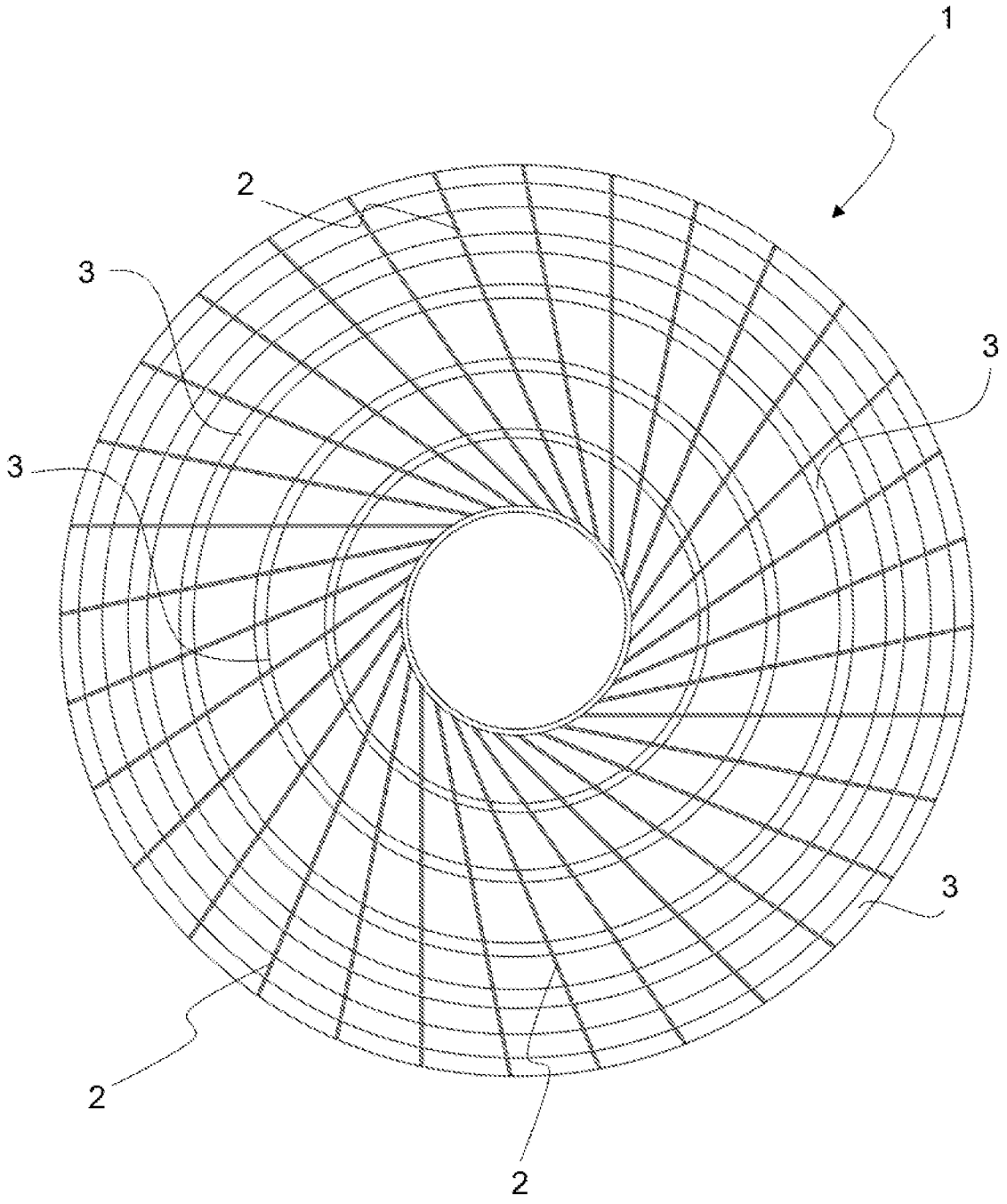
Figure 19:
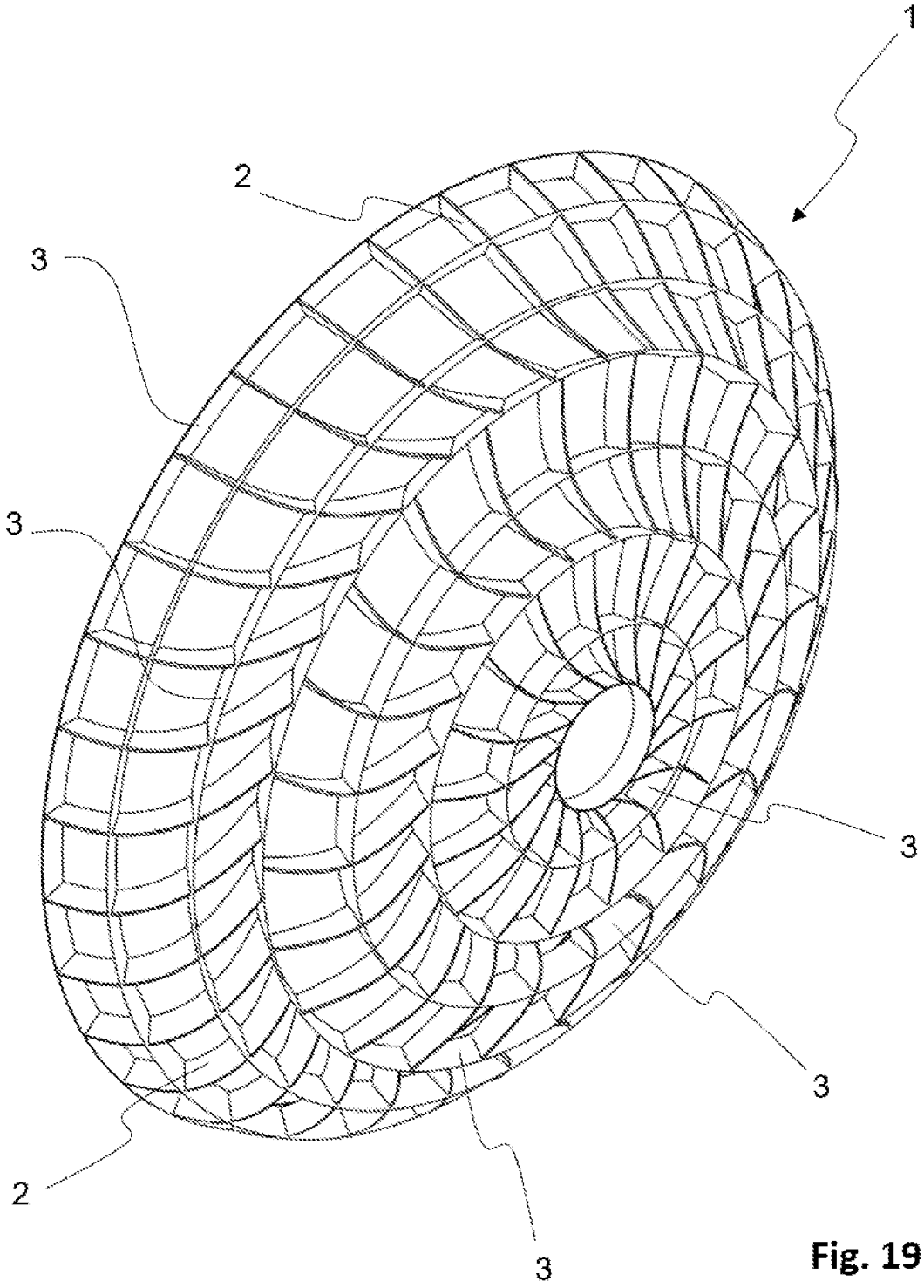
Figure 20:
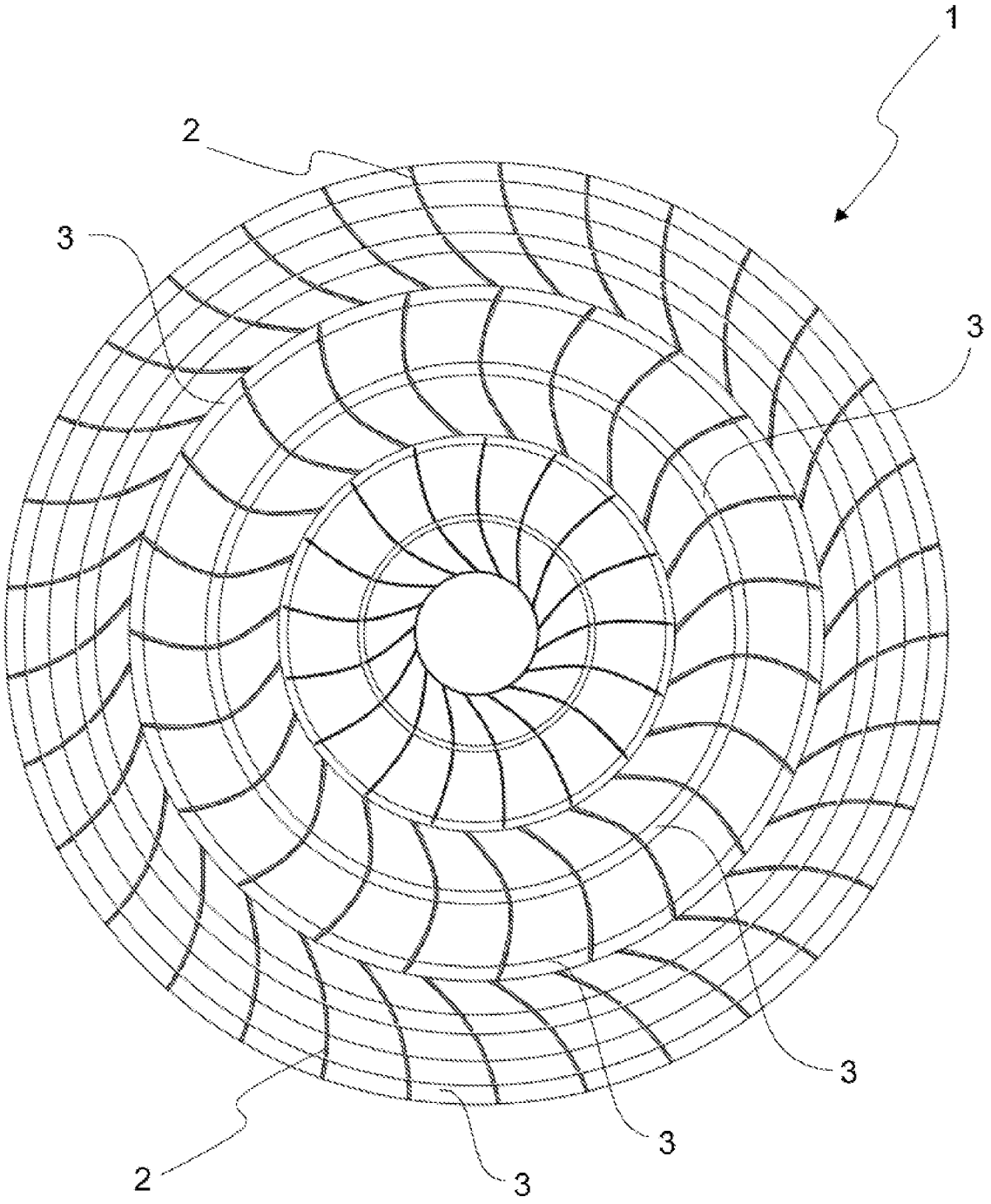

In the exemplary embodiment of a preguide grid 1 shown in FIGS. 4 to 8 it is important that the flow is also guided in the hub region of the fan on an inner wall of a hub structure 5. The flow guidance at the hub of the preguide grid 1 or the preguide device roughly passes over the impeller hub by contouring, as shown by the view of FIGS. 10, 11 and 12. The hub structure 5 may be formed as a single piece with the preguide grid 1, or it may form a separate part.

With the technique realized here, a significantly stronger pre-swirl can be effectively generated. Accordingly, the air flow can be substantially increased with such preguide grids, without any loss in efficiency. In fact, on the contrary the efficiency can even be slightly boosted.

A simulation has revealed that the air flow of an axial fan with 14° stagger angle can be boosted to the level of the fan with 24° stagger angle, and this with neutrality in terms of efficiency. A boosting to the level of the same fan with 19° stagger angle is possible, and this with a moderate boosting of efficiency. Furthermore, it has been determined that a better velocity distribution is achieved at a heat exchanger situated at the suction side. As a result, applications are favored by the preguide grid according to the invention, namely because of a better velocity distribution at the suction side.

The vanes 14 of the axial impeller 13 of the axial fan 7 are adjustable in their stagger angle. This possibility is very advantageous for the use of a preguide grid 1 with pre-swirl generation. For a fixed stagger angle, the preguide grid 1 in the exemplary embodiment increases the air flow by generating a pre-swirl contrary to the direction of rotation of the fan impeller 13. If one uses the preguide grid to adjust the stagger angle such that the same air flow is once more achieved as without a preguide grid, one can in this way accomplish this air flow with significantly higher efficiency than before. Hence, an axial fan without preguide grid can be replaced by an axial fan with preguide grid and modified stagger angle, achieving the same air flow at the same rotary speed, but at the same time increasing the efficiency. Consequently, neither does a larger motor have to be used.

Figure 1:
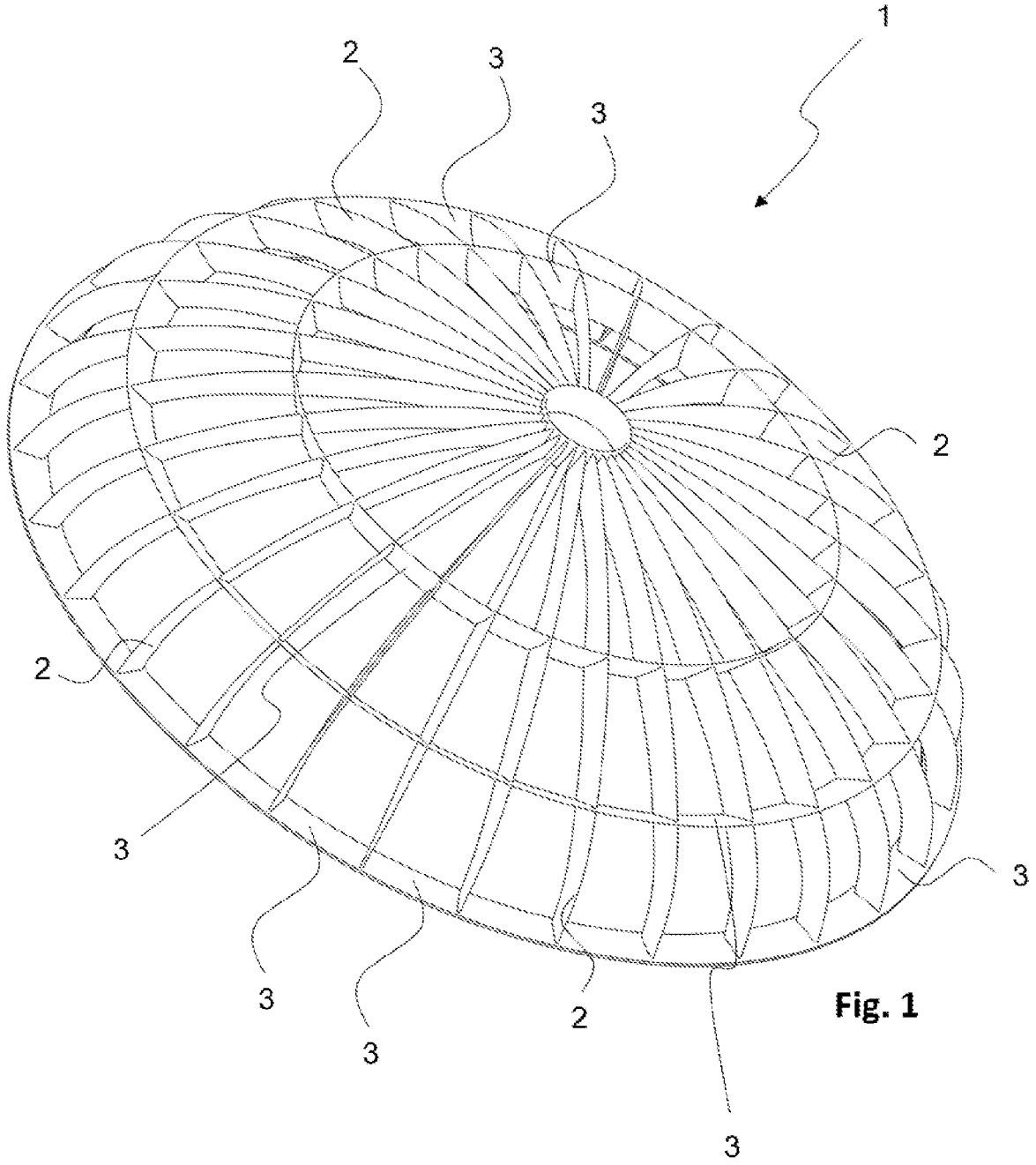
Figure 2:
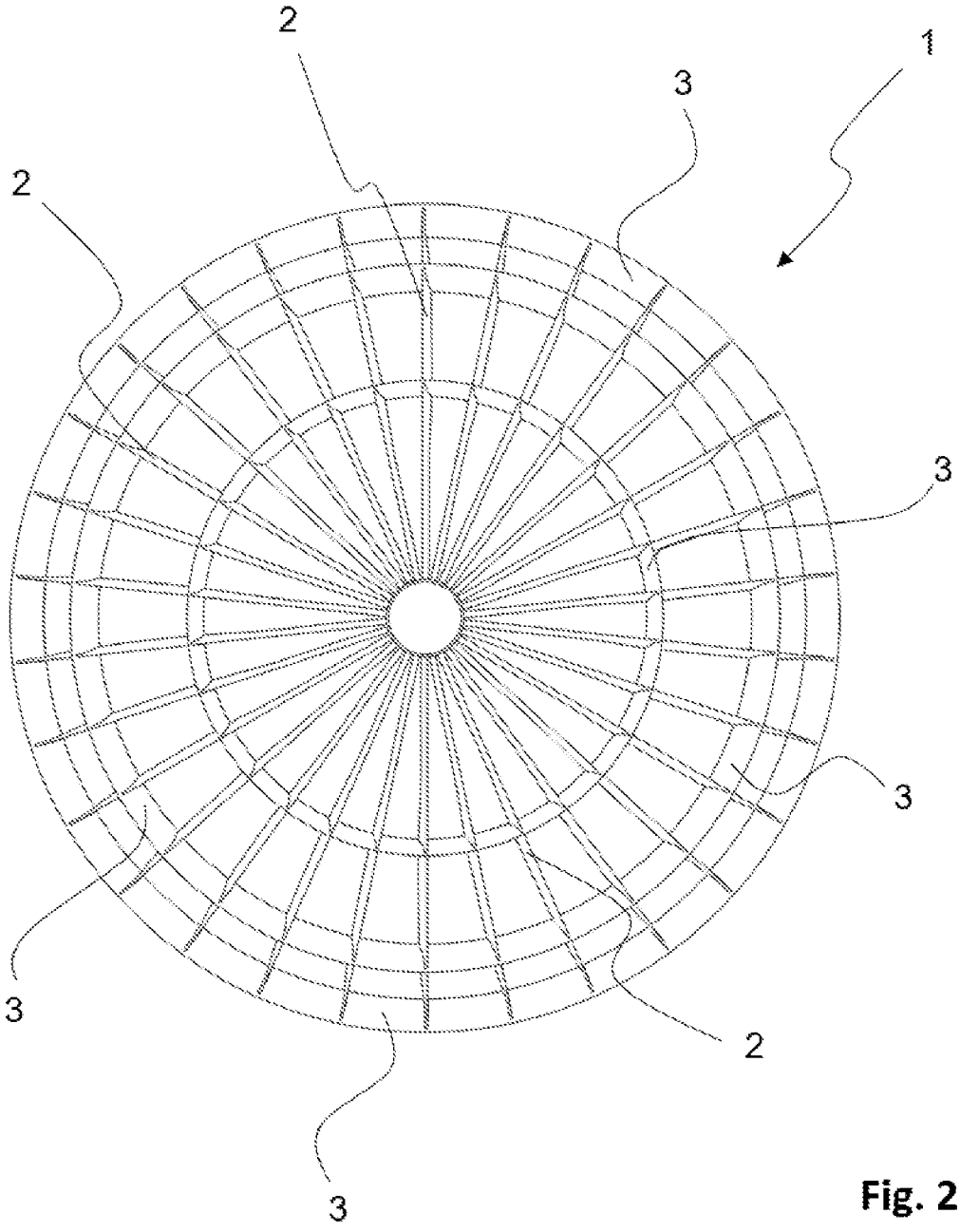
Figure 3:
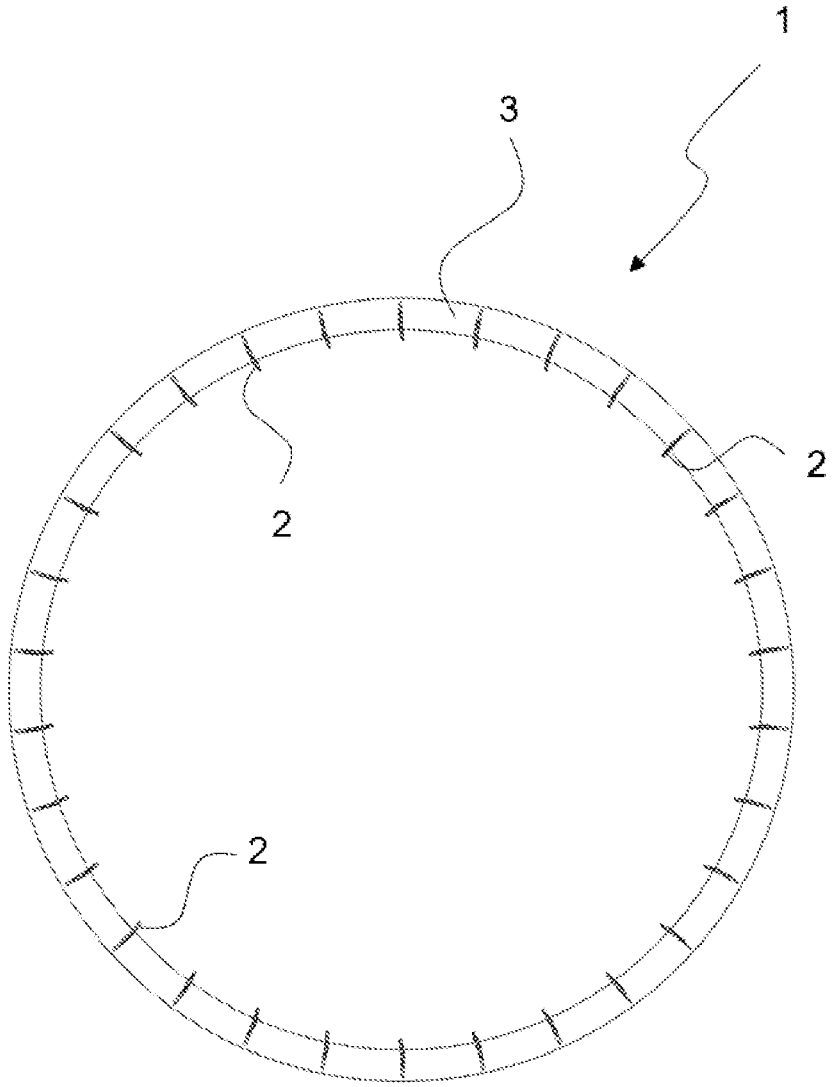
Figure 4:
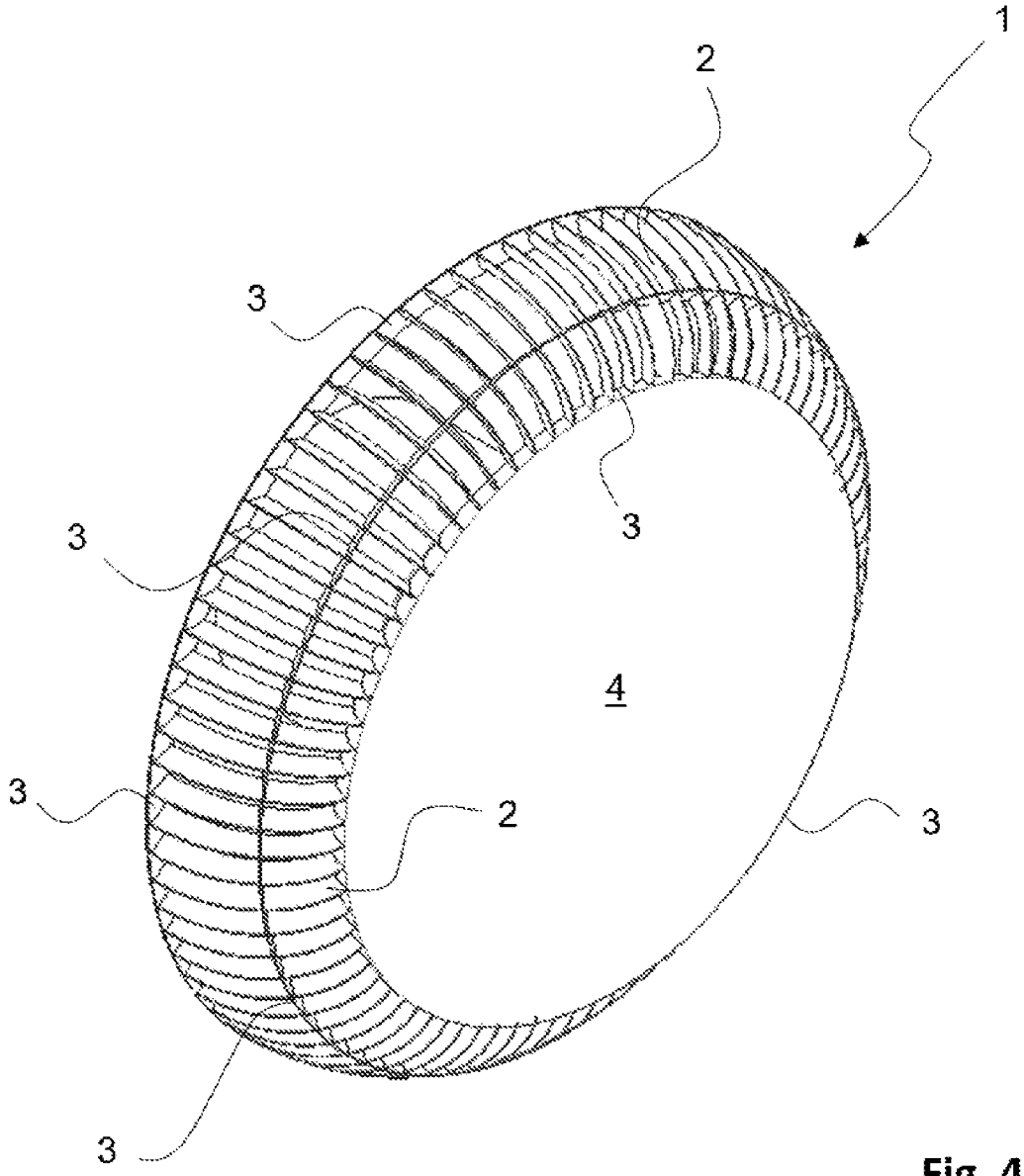
FIG. 4 shows another exemplary embodiment of a preguide grid 1 according to the invention for an axial fan, not shown in FIG. 4, in a perspective view.
Figure 5:
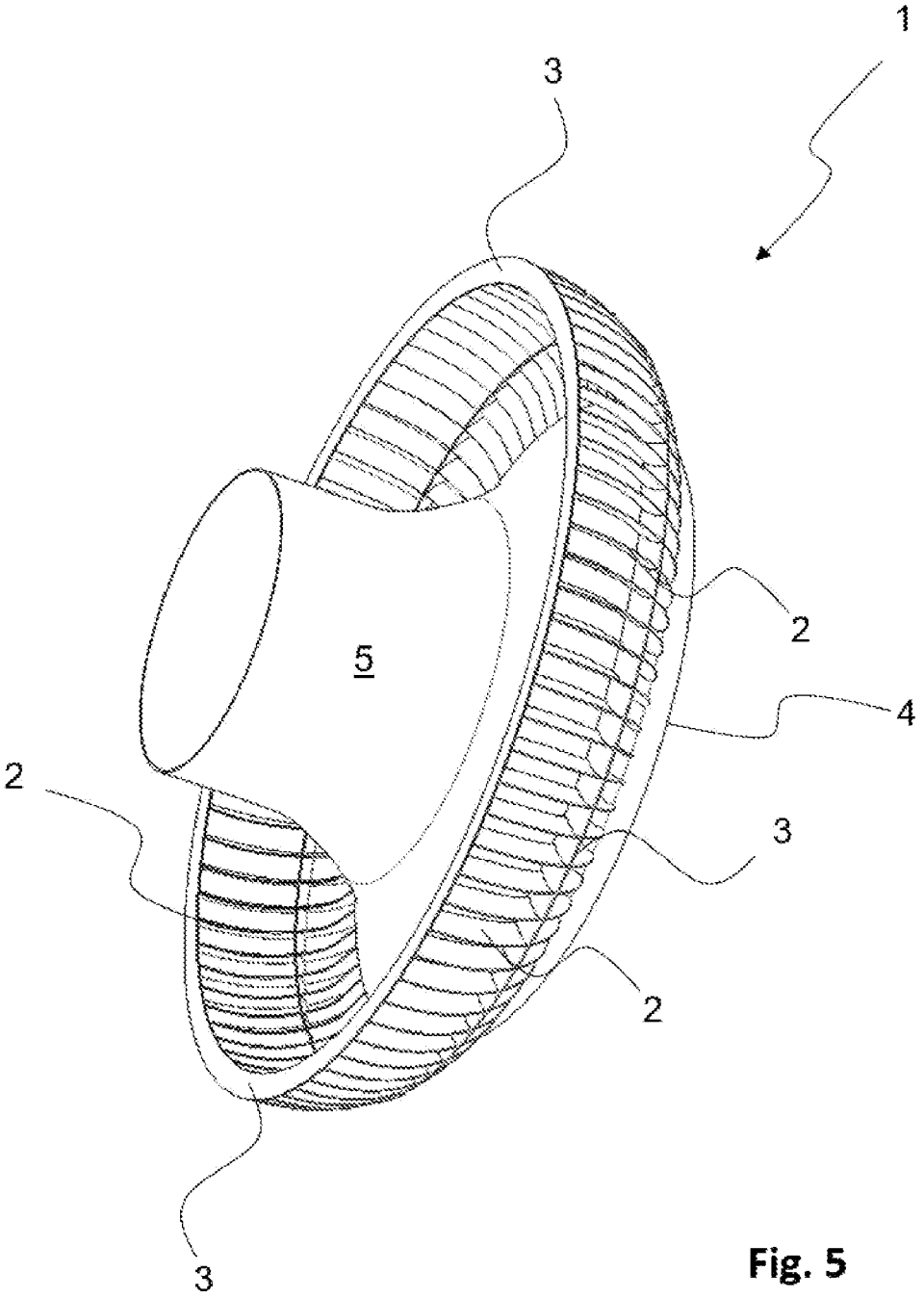
FIG. 5 shows the preguide grid 1 of FIG. 4 in a rear side view.
Figure 6:
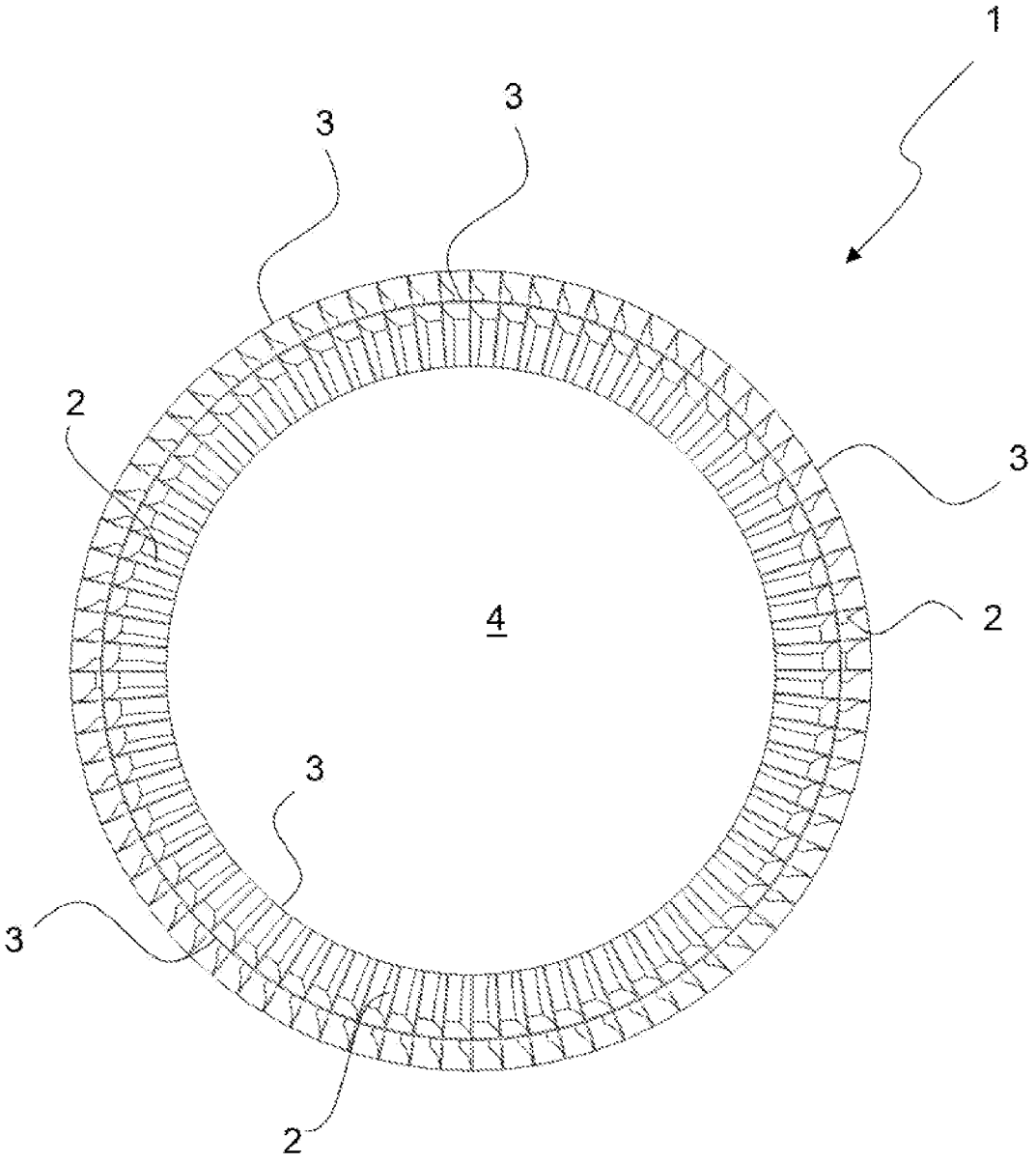
FIG. 6 shows the preguide grid 1 of FIGS. 4 and 5 in a front view.
Figure 7:
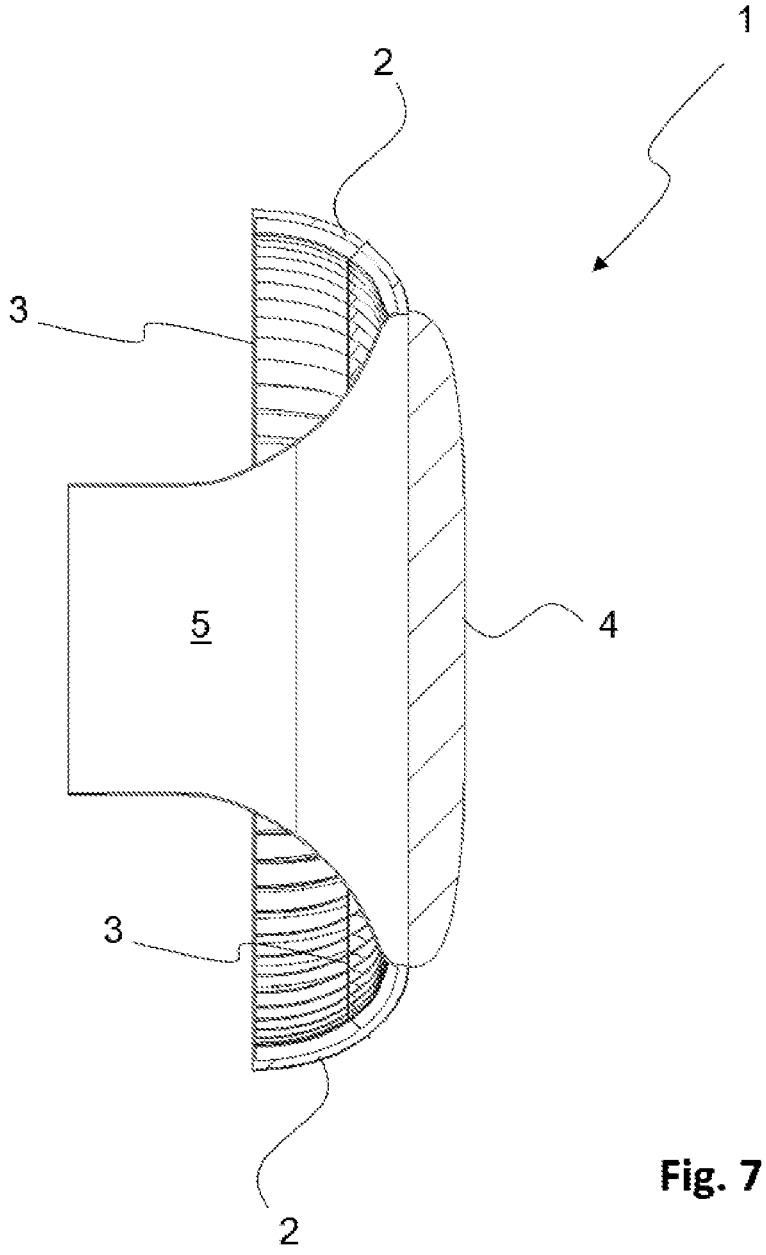
FIG. 7 shows the preguide grid 1 of FIGS. 4 to 6 in a cross section along the longitudinal axis and FIG. 8 shows it in a cross section in a plane transverse to the longitudinal axis.

In the representation of FIG. 7, the trend of the hub contour is quite visible. The flow hood 4 provided there can be made as a separate component, which is fastened to the preguide grid 1 itself. The inlet nozzle 9 would run somewhat parallel to the hub contour 5 in this exemplary embodiment in the assembled state of the overall fan. Accordingly, refer to FIGS. 10, 11 and 12.

Figure 8:
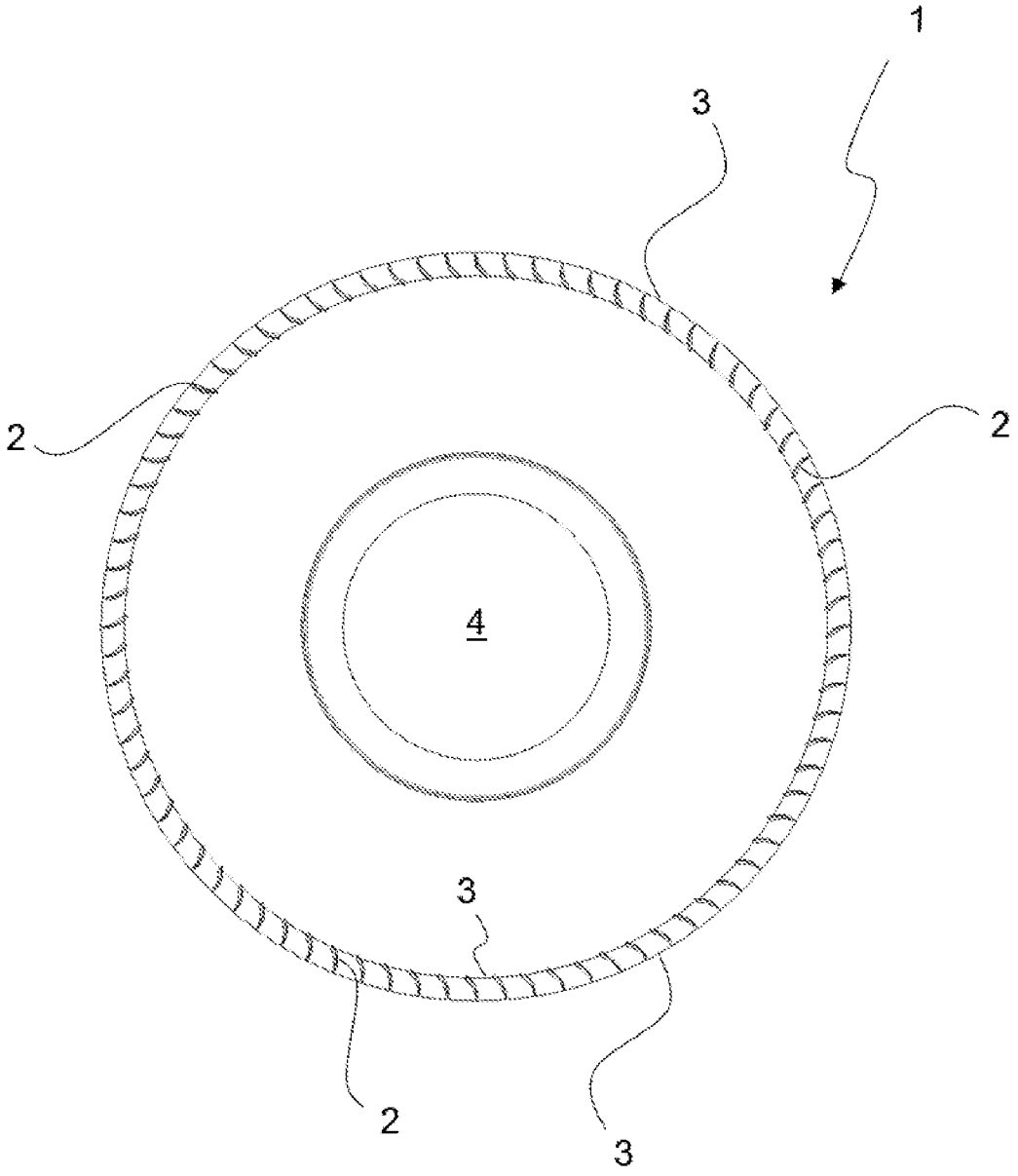
Figure 9:
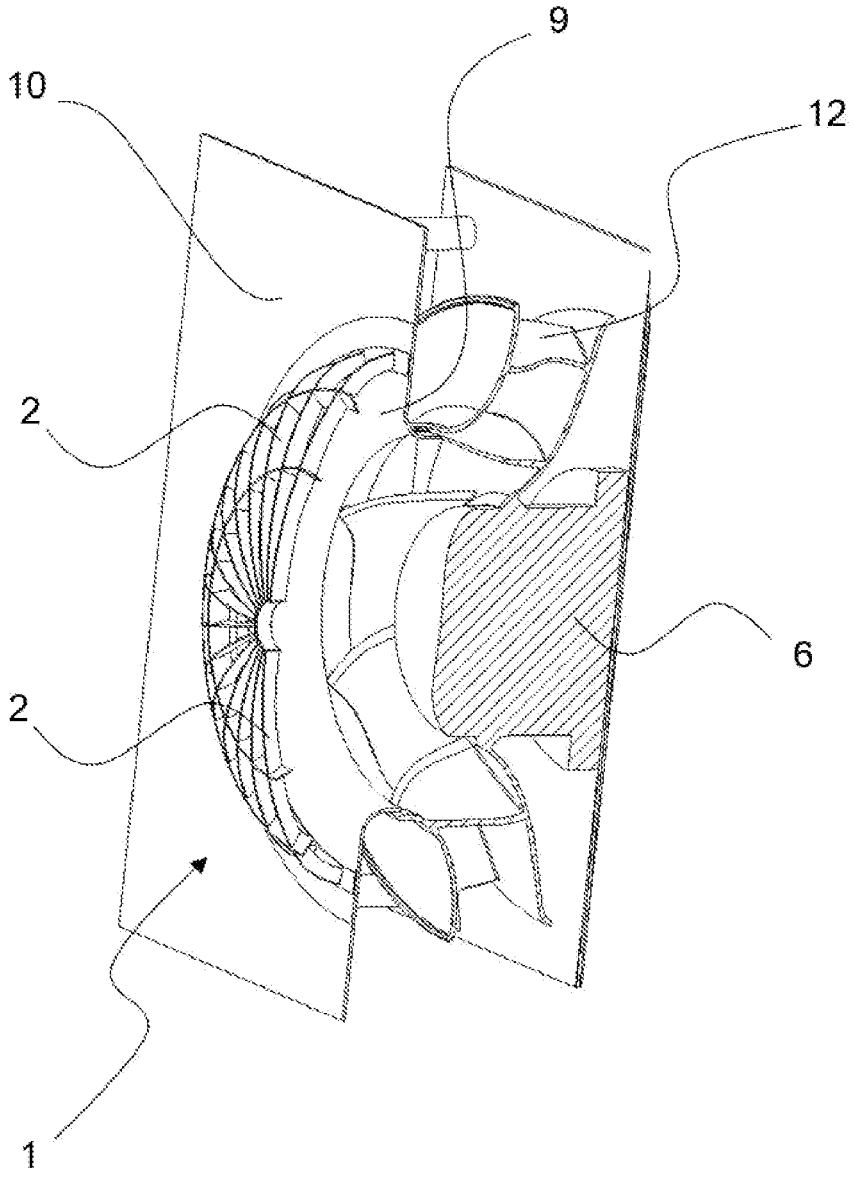

FIG. 8 shows in a front view the preguide grid according to the invention in a cross section transversely to the longitudinal axis. The inclined radial webs 2 show that a massive flow deflection of the air flow occurs here in the circumferential direction. The flow deflection advantageously occurs contrary to the direction of rotation of the fan impeller, not shown in FIG. 8. As for the normal vector of the skeletal surfaces, one can see that both the radial component nr and the circumferential component nφ are relatively large (both of them greater than 0.3 in magnitude for the radial webs 2 at the plane of the drawing in FIG. 8, i.e., the product nr*nφ is greater than 0.09 in absolute magnitude, which is a very large value and means a strong deflection). In this preguide grid, strong flow deflections are achieved in the circumferential direction; the ratio of the absolute magnitude of the circumferential velocity prior to entering the fan and the absolute magnitude of the total velocity is greater than 0.3, in a time and space average. The direction of rotation of the pre-swirl so generated in the example is opposite the direction of rotation of the fan impeller in operation. The strong pre-swirl increases the air flow of the fan significantly; it may be increased by more than 50% as compared to the operation of the fan without pre-swirl.

In FIG. 8 it can be seen that the radial webs 3 in the exemplary embodiment have no constant thickness, but instead have a profiling in cross section similar to an airfoil. This configuration makes possible a further reduction in the flow losses upon flowing through the grid, as well as an improvement in the aeroacoustical properties. However, the manufacturing in plastic injection molding is more difficult.

FIG. 10 shows the preguide grid 1 according to the invention in combination with an axial fan 7 having an axial impeller 13, which is also only suggested here. One can clearly see that the flow is also led in the hub region. The flow guidance at the hub passes over the impeller hub by contouring. The flow hood 4 and the hub contour 5 are well recognizable. The direction of rotation of the pre-swirl generated by the preguide grid is advantageously contrary to the direction of rotation of the axial impeller 13, in order to increase the air flow.

FIGS. 11 and 12 each show the fan 7 with axial impeller 13 having a preguide grid 1 according to the invention per FIG. 10, each time having a heat exchanger 8 arranged at the suction side. The preguide grid 1 according to the invention ensures a better velocity distribution of the air flow at the suction-side heat exchanger 8. In particular, space and time fluctuations of the inflow velocities are reduced by flowing through the preguide grid 1, which results in a reduction of the tonal noise at the fan. At the same time, the air flow is enhanced by the pre-swirl generation of the preguide grid 1.

FIG. 11 shows a rectangular heat exchanger 8, through which the fan sucks the air parallel to the axial direction. After flowing through the rectangular heat exchanger 8, spatial and temporal irregularities (fluctuations) occur in the inflow. These fluctuations are reduced by the preguide grid.

FIG. 12 shows a rectangular heat exchanger 8, through which the fan sucks the air transversely to the axial direction. This produces especially strong spatial and temporal irregularities (fluctuations) in the inflow, which in turn are reduced by the preguide grid. In this way, the tonal noise production at the fan is reduced.

In general, all kinds of described preguide grids can be combined with all kinds of fans (axial fans, radial fans).

Essential to the invention is the ability of a preguide grid to generate a pre-swirl, i.e., a circumferential component of the flow, in front of the entrance to the radial or axial impeller. This attribute may be traced back to certain geometrical properties of the skeletal surfaces or their normal vector distributions of the preguide grid, as described. The precise design of the preguide grid may be highly diverse. For example, a construction made of radial and circumferential webs need not be realized; alternatively, a construction similar to an unstructured grid or a honeycomb structure would be conceivable. The criteria for the normal vectors of the skeletal surfaces of the grid apply the same in such instances.

As regards further advantageous configurations of the device according to the invention, refer to the general part of the specification, as well as the appended claims, in order to avoid repetition.

Finally, it is expressly pointed out that the above described exemplary embodiments of the device according to the invention merely serve to explain the claimed teaching, but do not limit it to the exemplary embodiments.

LIST OF REFERENCE NUMBERS

1 Preguide grid (preguide device)
2 Radial webs
3 Transverse webs, circumferential webs

4 Flow hood
5 Hub structure
6 Radial fan
7 Axial fan
8 Heat exchanger
9 Inlet nozzle
10 Nozzle plate
11 Skeletal surfaces of webs
12 Radial impeller
13 Axial impeller
14 Axial vane

The invention claimed is:

1. A fan comprising:

an impeller; and a pre-guide device in a flow path on a suction side of the impeller and in a front side of an inlet region of an inlet nozzle of the fan, the pre-guide device comprising a pre-guide grid having webs arranged and shaped such that:

a flow influencing in a circumferential direction occurs for a substantially swirl-free inflow; and a total passage area for air at the pre-guide is greater than a smallest passage area in the inlet nozzle on the suction side by at least a factor of two.

2. The fan according to claim 1, wherein the webs are arranged and shaped such that a pre-swirl is generated against a direction of rotation of the impeller by means of a flow deflection of a substantially swirl-free inflow.

3. The fan according to claim 1, wherein at least some of the webs extend substantially radially, comprising radial webs.

4. The fan according to claim 3, wherein the radial webs of the pre-guide grid comprise curved guide vanes, wherein the radial webs are interconnected by transverse webs to a grid.

5. The fan according to claim 3, wherein the pre-guide grid comprises at least 25 radial webs across an outer circumference of the fan.

6. The fan according to claim 3, wherein the webs deviate from an exactly radial orientation.

7. The fan according to claim 3, wherein the webs are at least one of:

inclined, curved, rotated, and twisted.

8. The fan according to claim 1, wherein the pre-guide grid is of a hood-like design.

9. The fan according to claim 1, wherein the pre-guide grid has a form of an annular ring.

10. The fan according to claim 9, further comprising a flow hood adjoining the pre-guide grid, wherein the flow hood guides the flow on an inner contour in an inner region of the fan.

11. The fan according to claim 1, wherein the pre-guide grid comprises at least 50 narrow air passages.

12. The fan according to claim 1, wherein the pre-guide grid is at least partially made of injection-molded plastic.

13. The fan according to claim 12, wherein an injection mold for the pre-guide grid requires no sliders.

14. The fan according to claim 1, characterized in that a heat exchanger is arranged at the suction side.

15. A pre-guide grid for a fan, the pre-guide grid comprising webs arranged and shaped such that, when the pre-guide grid is placed in a flow path in a suction side of an impeller included in the fan and in a front side of an inlet region of an inlet nozzle of the fan:

a flow influencing in a circumferential direction occurs for a substantially swirl-free inflow; and a total passage area for air at the pre-guide is greater than a smallest passage area in the inlet nozzle on the suction side by at least a factor of two.

* * * * *